US006372419B1

(12) United States Patent
Inaba et al.

(10) Patent No.: US 6,372,419 B1
(45) Date of Patent: Apr. 16, 2002

(54) SILVER HALIDE PHOTOGRAPHIC MATERIAL

(75) Inventors: Tadashi Inaba; Tadanobu Sato; Kohzaburoh Yamada; Takahiro Matsuno, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/614,454

(22) Filed: Jul. 12, 2000

(30) Foreign Application Priority Data

| | | |
|---|---|---|
| Jul. 13, 1999 | (JP) | 11-199211 |
| Jul. 29, 1999 | (JP) | 11-215621 |
| Mar. 14, 2000 | (JP) | 2000-070750 |
| May 25, 2000 | (JP) | 2000-154804 |
| May 25, 2000 | (JP) | 2000-154805 |

(51) Int. Cl.[7] ..... G03C 1/035; G03C 1/09; G03C 1/10

(52) U.S. Cl. ..... 430/567; 430/600; 430/604; 430/605; 430/936

(58) Field of Search ..... 430/600, 604, 430/612, 936, 567

(56) References Cited

U.S. PATENT DOCUMENTS

| | | | | |
|---|---|---|---|---|
| 3,482,972 A | * | 12/1969 | Idelson | 430/224 |
| 5,213,951 A | * | 5/1993 | Delfino | 430/504 |
| 5,360,712 A | | 11/1994 | Olm et al. | 430/567 |
| 5,457,021 A | | 10/1995 | Olm et al. | 430/567 |
| 5,462,849 A | | 10/1995 | Kuromoto et al. | 430/567 |
| 5,468,599 A | * | 11/1995 | Biavasco et al. | 430/512 |

* cited by examiner

*Primary Examiner*—Richard L. Schilling
(74) *Attorney, Agent, or Firm*—Sughrue, Mion, Zinn, Macpeak & Seas, PLLC

(57) ABSTRACT

A silver halide photographic material comprising a support having provided thereon at least a silver halide emulsion layer, wherein the material contains at least one metal complex contained in any of groups A, B and C:

group A: an optically active metal complex;

group B: a metal complex comprising a metal ion selected from the group consisting of transition metallic elements belonging to period 4 to 6 and group III to XI of the Periodic Table, and typical metallic elements belonging to period 4 to 6 and group XII to XIV of the Periodic Table, and at least one ligand represented by the following formula (I):

(I)

wherein Z represents an atomic group to form a 5- or 6-membered ring; A represents a carbon atom or a nitrogen atom; X represents $O^{31}$, $S^{31}$ , $NR_1R_2$ or $COO^-$; $R_1$ and $R_2$ each represents a hydrogen atom or an alkyl group; R represents a substituent; and n represents 0 or an integer of from 1 to 6;

group C: a metal complex selected from a porphyrin complex, a porphycene complex, a phthalocyanine complex, a chlorin complex, and a bacteriochlorin complex.

17 Claims, No Drawings

SILVER HALIDE PHOTOGRAPHIC MATERIAL

FIELD OF THE INVENTION

The present invention relates to a silver halide photographic material using a metal complex, and more particularly to a high speed silver halide emulsion using a doping technique.

BACKGROUND OF THE INVENTION

As one technique of improving the performance of a silver halide photographic material at large as desired by reforming silver halide grains, a technique of incorporating substances other than a silver ion and a halide ion into silver halide grains, i.e., a technique of doping a dopant, is known. In particular, with respect to doping techniques of transition metal ions, a number of studies have been done for years. It is generally known that a transition metal ion effectively reforms photographic performances if it gets into silver halide grains as a dopant even with an extremely trace addition amount.

For increasing the sensitivity of a silver halide emulsion, a technique of doping not only a transition metal ion but also a transition metal complex having a cyanide ion as a ligand into silver halide grains has been known. In particular, many examples are disclosed with respect to emulsions which are highly sensitized by doping with VIII group metal complexes having six cyanide ions as the ligand. As a dopant containing a cyanide ion, yellow prussiate of potash which is hexacyanoferrate (II) complex, and red prussiate of potash which is hexacyanoferrate(III) complex are disclosed in JP-B-48-35373 (the term "JP-B" as used herein means an "examined Japanese patent publication"). However, in this invention, the effect of higher sensitization is limited to the case of containing an iron ion and is not related to the kind of a ligand. There are many examples of obtaining high speed emulsions by doping with hexacyanoferrate (II) complex, e.g., those disclosed in JP-A-5-66511 (the term "JP-A" as used herein means an "unexamined published Japanese patent application") and U.S. Pat. No. 5,132,203. High speed emulsions which can be obtained by doping with cyano complexes other than iron complexes are known, e.g., it is disclosed in JP-A-2-20853 that high speed silver halide emulsions can be obtained when silver iodochloride is doped with rhenium, ruthenium, osmium and iridium complexes. Many complexes containing other metal ions are also used as dopants and the effects brought about by doping are various, such as not only higher sensitization but also the improvement of reciprocity law failure and higher contrast. It is disclosed in U.S. Pat. No. 2,448,060 that an emulsion doped with a platinum complex having a halogen ion as a ligand or a palladium (III) complex is sensitized. Emulsions which are doped with cyano complexes of iron(II) and iron(III), emulsions doped with cyano complexes of cobalt (III) as well, are disclosed in U.S. Pat. No. 3,790,390, in addition, silver halide emulsions containing spectral sensitizing dyes are disclosed. Silver halide grains formed in the presence of rhodium(III) complexes having 3, 4, 5 or 6 cyanide ions as ligands are disclosed in U.S. Pat. No. 4,847,191. It is shown in these patents that high intensity reciprocity law failure is reduced due to dopants. Silver halide emulsions doped with rhenium, ruthenium, osmium or iridium having 4 or more cyano ligands are disclosed in EP 0336425, EP 0336426, and JP-A-2-20854. It is disclosed in these patents that the sensitivity and gradation stabilities with the lapse of time are improved and low intensity reciprocity law failure is improved. Silver halide emulsions using six-coordinated vanadium, chromium, manganese, iron, ruthenium, osmium, rhenium or iridium complex containing nitrosyl or thionitrosyl ligands are disclosed in EP 0336427 and JP-A-2-20852, and low intensity reciprocity law failure is improved without lowering middle intensity sensitivity. As dopants other than transition metal ions, emulsions doped with bismuth or lead ions are disclosed in U.S. Pat. No. 3,690,888, and emulsions containing metal ions belonging to group XIII and group XIV of the Periodic Table are disclosed in JP-A-7-128778.

Among the ligands of complexes which are used as dopants the most numerous are probably cyanide ions, and halide ions are also used numerously. For example, as an example that a complex having the structure of $(MCl_6)^{n-}$, with M being an arbitrary metal, is doped, hexachlororuthenium, hexachloroiridium, hexachlororhodium and hexachlororhenium as disclosed in JP-A-63-184740, JP-A-1-285941, JP-A-2-20852 and JP-A-2-20855 can be exemplified. Examples of a dopant such as a six-coordinated rhenium complex containing halogen, nitrosyl, thionitrosyl, cyan, water, and thiocyan as each ligand is disclosed in EP 0336689 and JP-A-2-20855, a transition metal complex which is a six-coordinated metal complex containing carbonyl as one ligand is disclosed in JP-A-3-118535, and an emulsion containing a transition metal complex which is a six-coordinated metal complex containing oxygen atoms as two ligands is disclosed in JP-A-3-118536, these are disclosed as emulsions having useful photographic performances.

As described above, the central metals and ligands of complexes used as dopants are various, and further in recent years techniques for reforming the property of an emulsion by doping a complex having an organic compound as a ligand have come to be disclosed. Examples in which complexes having various organic compounds as ligands are used are disclosed in U.S. Pat. Nos. 5,360,712, 5,457,021, 5,462,849, EP 0709724, JP-A-7-72569 and JP-A-8-179452, and there are disclosed that the effect of increasing sensitivity is particularly large when $[(NC)_5Fe(\mu\text{-}4,4'\text{-bipyridine})Fe(CN)_5]^{6-}$ is doped. However, the metal complexes having organic ligands disclosed in these patents have a drawback that when they are dissolved in a gelatin aqueous solution in doping to a silver halide grain, they are decomposed rapidly (it is presumed that the organic ligand parts deviate because the spectral absorption spectra vary largely). Emulsions whose high sensitivity and reciprocity law failure are improved due to doping with $[Fe(CO)_4(P(Ph)_3)]^0$ or $[Fe(CO)_3(P(Ph)_2)]^0$ are disclosed in JP-A-11-24194, however, these complexes are also unstable in water and a gelation aqueous solution and decomposed with aging when they have been completely dissolved. In JP-A-11-102042 are disclosed high speed emulsions obtained by doping with $[M(CN)_5L]^{3-}$ (M represents $Fe^{2+}$, $Ru^{2+}$ or $Ir^{3+}$), $[Fe(CO)_4L]^0$, $[M'(CN)_3L]^-$ (M' represents $Pd^{2+}$ or $Pt^{2+}$) or $[IrCl_5L]^{2-}$ and 2-mercaptobenzimidazole, 5-methyl-s-triazolo[1.5-A] pyrimidine-7-ol, or 2-mercapto-1,3,4-oxadiazole is used as L. However, cyanide and CO in these metal complexes are liable to deviate and liberate into the system and have a harmful influence on the system. In JP-A-10-293377, it is disclosed that the emulsions doped with $[RuCl_5L']^{2-}$ (L' represents imidazole, benzimidazole or derivatives thereof) are conspicuously improved in high contrast, and the sensitivity at that time becomes largely higher than that of emulsions doped with conventional desensitized high contrast dopants. However, almost all of the ligands used in the complexes in these patents are nitrogen atoms and there are almost no dopants having oxygen atoms as ligands, and examples of using complexes coordinated with oxygen atoms of ketone as dopants are not known.

When a complex having a six-coordinationated octahedral structure is incorporated into a silver halide grain as a dopant, as described in *J. Phys.: Condens. Matter* 9, pp. 3227 to 3240 (1997) and other references and patents, it is thought that $[AgX_6]^{5-}$ unit (X is a halogen ion) in the silver halide grain and the molecule of the complex are replaced, and the central metal occupies the lattice position of the $Ag^+$ ion, and each ligand occupies the lattice position of the halide ion. It is disclosed in U.S. Pat. No. 5,360,712 that, therefore, not less than half of the coordination site of the central metal of the complex to be used as a dopant should be halogen or pseudo-halogen ions and further an organic compound capable of being used as a ligand should have an appropriate molecular size to the size of the space in the crystal lattice to be a host.

On the other hand, examples of using, as dopants, complexes in which halogen or pseudo-halogen ions are not bonded to the coordination site of the metal ions such as $[Fe(EDTA)]^2$ (EDTA: ethylenediaminetetraacetic acid) and $[Ir(C_2O_4)_3]^{3-}$ are disclosed in U.S. Pat. No. 3,672,901, JP-A-2-259749 and JP-A-4-336537. The foregoing U.S. Pat. No. 5,360,712 discloses that the effect as dopants of these complexes is not large, because these complexes are not appropriate as dopants since all the coordination site are occupied by the organic compounds in these complexes, as a result the complexes are taken into the silver halide grain, and the complexes cannot have necessary halogen or pseudo-halogen ions. JP-A-5-341426 discloses emulsions to which complexes such as $[(Ru(bpy)_2Cl_2]^0$ (bpy: 2,2'-bipyridine) and others are added, and the same patent discloses that the effect of improving photographic performance by the complexes is not so large when added during grain formation but they exhibit a marked effect when they are added to the grain surface together with a dye after grain formation.

Considering that the complexes as dopants are taken into a silver halide grain, when complexes having organic compounds as ligands are used as dopants, organic compounds as the ligands occupy only one or two of six coordination sites of central metal so far as hitherto known, and examples in which photographic performances can be improved by complexes comprising organic compounds occupying more than half or all the coordination site have not been known.

On the other hand, for obtaining emulsions having a high speed, means for giving chemical sensitization becomes necessary other than doping. Gold sensitization is a representative chemical sensitization, but as disclosed, e.g., in JP-A-8-62761, in the emulsion doped with cyano complexes, cyanide ions liberated from the complexes are adsorbed onto the silver halide grain surface to form a gold-cyano complex with the gold ions added as the chemical sensitizer and hinder the formation of sensitization specks by the gold sensitizer. Therefore, for gold sensitizing the emulsion doped with a cyano complex, as disclosed in U.S. Pat. No. 5,132,203 and EP 0508910, the cyano group whose subsurface has been doped with a cyano complex should be kept away from the silver halide grain surface. A method of adding zinc ions, etc., to silver halide grains is known to prevent the hindrance of gold sensitization as disclosed in JP-A-6-308653. As described above, for reconciling the improvement of sensitivity by the dopant depending upon cyano complexes and gold sensitization, any further measures should be taken.

At present time, almost all the dopants which bring about higher sensitization are complexes with cyanide ions as the ligands, and the problem of the strong toxicity of cyan compounds still remains even if the drawback of the hindrance of gold sensitization is resolved, therefore, a dopant which can provide a highly sensitized emulsion free from cyanide ions has been desired. The improvement of sensitivity is an important problem in the photography, and there is no satisfactory level and further improvement has been desired all the time.

SUMMARY OF THE INVENTION

Accordingly, a first object of the present invention is to provide a silver halide photographic material having a high speed, a second object is to provide a silver halide photographic material giving a high Dmax (i.e., maximum color density), a third object is to provide a high speed silver halide photographic material capable of easily introducing dislocation lines even with tabular silver halide grains having an aspect ratio of 8 or more, a fourth object is to provide a higher speed silver halide photographic material free from a cyanide ion, and a fifth object of the present invention is to provide a silver halide photographic material which can be doped stably even when the doping solution is prepared under severe conditions in the presence of gelatin and which shows less unevenness of performances according to the addition conditions.

These objects of the present invention have been accomplished by the following described means of (1) to (13).

(1) A silver halide photographic material comprising a support having provided thereon at least a silver halide emulsion layer, wherein the material contains at least one metal complex contained in any of groups A, B and C:

group A: an optically active metal complex;

group B: a metal complex comprising a metal ion selected from the group consisting of transition metallic elements belonging to period 4 to 6 and group III to XI of the Periodic Table, and typical metallic elements belonging to period 4 to 6 and group XII to XIV of the Periodic Table, and at least one ligand represented by the following formula (I):

(I)

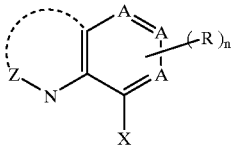

wherein Z represents an atomic group to form a 5- or 6-membered ring; A represents a carbon atom or a nitrogen atom; X represents $O^-$, $S^-$, $NR_1R_2$ or $COO^-$; $R_1$ and $R_2$ each represents a hydrogen atom or an alkyl group; R represents a substituent; and n represents an integer of from 0 to 6;

group C: a metal complex selected from the group consisting of a porphyrin complex, a porphycene complex, a phthalocyanine complex, a chlorin complex, and a bacteriochlorin complex.

(2) The silver halide photographic material as described in the above item (1), wherein the metal complex of group A is an optically active metal complex having as a central metal a metal ion selected from the group consisting of transition metallic elements belonging to period 4 to 6 and group III to XI of the Periodic Table, and typical metallic elements belonging to period 4 to 6 and group XII to XIV of the Periodic Table.

(3) The silver halide photographic material as described in the above item (2), wherein the optically active metal complex of group A is a Δ body or Λ body.

(4) The silver halide photographic material as described in the above item (2), wherein the optically active metal complex of group A is a complex having at least one diketone compound as a ligand.

(5) The silver halide photographic material as described in the above item (1), wherein the metal complex of group B is a metal complex exclusive of complexes in which half or more conformations of all the ligands of the metal ions are occupied with monovalent anionic ligands.

(6) The silver halide photographic material as described in the above item (1), wherein the metal complex of group C is a metal complex selected from the group consisting of a porphyrin complex having a hydrophilic group, a porphycene complex having a hydrophilic group, a phthalocyanine complex having a hydrophilic group, and a bacteriochlorin complex having a hydrophilic group, and each of which contains a metal ion selected from the group consisting of transition metallic elements belonging to period 4 to 6 and group III to XI of the Periodic Table, or typical metallic elements belonging to period 4 to 6 and group XII to XIV of the Periodic Table.

(7) The silver halide photographic material as described in the above item (6), wherein the metal ion contained in the metal complex is a transition metallic element belonging to period 4 to 6 and group III to XI of the Periodic Table.

(8) The silver halide photographic material as described in the above item (7), wherein the hydrophilic group contained in the metal complex is a carboxyl group, a sulfo group, a hydroxyl group, or a quaternary salt (a quaternary ammonium salt, a pyridinium salt).

(9) The silver halide photographic material as described in the above item (8), wherein the solubility of the complex in water is 1 mM or more.

(10) The silver halide photographic material as described in the above item (1) , wherein the material contains silver halide grains into which dislocation lines are introduced.

(11) The silver halide photographic material as described in the above item (10), wherein the dislocation lines are screw dislocations.

(12) The silver halide photographic material as described in any of the above items (1) to (11), wherein the material contains at least one silver halide emulsion in which tabular silver halide grains having an aspect ratio of 8 or more account for 60% or more of the entire projected area.

(13) The silver halide photographic material as described in any of the above items (1) to (12) which comprises a support having provided thereon at least one blue-sensitive emulsion layer, a green-sensitive emulsion layer, a red-sensitive emulsion layer and a hydrophilic protective colloid layer.

DETAILED DESCRIPTION OF THE INVENTION

In the first place, an optically active metal complex of group A will be described below.

"An optically active metal complex" used herein means a complex whose plane of polarization of plane polarized light can be rotated. Isomers which are in relationship of mirror images and cannot be superposed are present in optically active metal complexes and these isomers are called optical isomers to each other and the rotating directions of the optical isomers are reverse. Those comprising the ratio of optical isomers of 1/1 and whose plane of polarization does not rotate are called racemic bodies. Various optically active metal complexes have been already known but it has been believed that optical activity does not act on photographic performances. The present inventors have actually added some optically active organic compounds (organic compounds which do not contain metals and have asymmetric carbon atoms) to photographic materials to compare performances with those by racemic bodies but no difference has been found at all. However, as a result of adding an optically active metal complex to silver halide grains this time, the present inventors obtained performance results apparently different from those by racemic bodies. Further, the present inventors have found that the optically active metal complex is superior to racemic bodies in view of the effect of improving sensitivity.

Examples of controlling photographic sensitivity by adding optically active metal complexes to photographic materials, in particular, to silver halide grains, are not hitherto known so far as the present inventors have searched for. Complexes which have so far been used as a dopant are generally antipodal and do not have optical activity, or they can take optically active complex structure but do not have optical activity because of racemic bodies in almost all the cases. For instance, complexes having cyanide ions such as yellow prussiate of potash (JP-B-48-35373) and heterocyclic compounds such as 4,4'-bipyridine (JP-A-7-72569) as ligands are representative, and it is unexpected that the improvement of photographic performances such as higher sensitization can be realized by optically active metal complexes.

Optically active metal complexes as described in the claims will be described in detail below.

The metal complex described in claim 1 may have any metal. Examples of preferred transition metals include scandium, titanium, vanadium, chromium, manganese, iron, cobalt, nickel, copper, yttrium, zirconium, niobium, molybdenum, ruthenium, rhodium, palladium, silver, lanthanoid (lanthanum, cerium, praseodymium, neodymium, promethium, samarium, europium, gadolinium, terbium, dysprosium, holmium, erbium, thulium, ytterbium, lutetium), hafnium, tantalum, tungsten, rhenium, osmium, iridium, platinum and gold, and examples of preferred typical metals include aluminum, zinc, gallium, germanium, indium, tin, thallium and lead. More preferred examples include iron, ruthenium, osmium, cobalt, rhodium, iridium, copper, palladium, platinum and gold, more preferred are metal ions selected from ruthenium, osmium, cobalt, rhodium, and iridium, and particularly preferred is cobalt.

Optically active complexes take some forms and any form may be used in the present invention, and the effect of improving sensitization can be effected with every optically active complex. The optically active complexes can be classified into the following forms, e.g., (1) complexes which contains optically active ligands, (2) complexes which do not contain optically active ligands but optical activity is brought about due to the absolute configurations of the complexes (e.g., A body, A body), (3) complexes which contains optically active ligands and further optical activity is brought about due to the absolute configurations of the complexes, and (4) complexes which have optically active compounds as counter ions (organic compounds or complexes) and form salts. Complexes (1) to (3) are preferred among these and more preferred is (2).

Optically active complexes can exhibit the effect of improving the sensitivity of silver halide emulsions in their own way even if their optical purity is low, but the effect is high when optical purity is high after all. Optically active complexes preferably have optical purity of 50% ee or more, more preferably 70% ee or more, and particularly preferably 80% ee or more.

The coordination type of complexes is not particularly limited and any type can be used (e.g., plane quadrangular type, tetrahedral type, cubic type, octahedral type), but preferred are octahedral type complexes, and octahedral type complexes containing two or three bidentate ligands are more preferred. Octahedral type complexes having absolute configurations of Δ body or A body are particularly preferred.

Optically active metal complexes may have two or more metal ions and they may be the same or different. Preferred are complexes in which at least two metal ions are the same, and more preferred are the case in which all the metal ions are the same, however, optically active metal complexes are preferably mononuclear metal complexes.

Optically active metal complexes may have any of generally known ligands, e.g., organic ligands described in *Comprehensive Coordination Chemistry,* Vol. 4, "Middle Transition Elements", pp. 1 to 1271, Pergamon Press, and Kagehei Ueno, *Chelate Kagaku* (2) (*Chemistry of Chelate* (2)), pp. 231 to 248, Nankodo Publishing Co. Ltd. can be used.

Representative organic ligands are described below but the present invention is not limited to these compounds and any of the organic compounds described in the above references can be preferably used.

1) Acetylacetonate
2) N,N'-ethylene-bis(acetylacetoneiminate)
3) 2,2'-Bipyridine
4) Bipyrazinyl
5) 2,2'-Bipyridylamine
6) Ethylenediaminetetraacetate
7) Ethylenediamine
8) Glycine
9) Oxalate
10) 8-Hydroxyquinoline
11) Picolinic acid
12) 1-Propylenediamine
13) Tartrate
14) Ethylenediaminediacetate
15) Trifluoroacetylacetonate
16) Dipivaloylmethane
17) L-Alanine
18) D-1,2-Propylenediamine
19) o-Phenanthroline
20) (S)–$[^{-}O_2CCH(CHMe_2)NH(CH_2)_2CH(CHMe_2)CO_2^{-}]$
21) 4,4'-Dimethyl-2,2'-bipyridine
22) (R)–$[CH(OH)C_2^{-}]_2$
23) Dithioacetylacetonate
24) (S)–$[^{-}O_2CCH_2CH(OH)CO_2^{-}]$
25) (S,S)-Ethylenediaminedisuccinate
26) $NH_2CH(CO_2Me)CH_2S^{-}$
27) $[NH_2CH(CO_2^{-})CH_2S^{-}]_2$
28) $(H_2NCH_2CH_2Se)_2$ These organic ligands may have a substituent, and examples of the substituents include, e.g., a straight chain, branched or cyclic alkyl group (preferably having from 1 to 20, more preferably from 1 to 10, and particularly preferably from 1 to 4, carbon atoms, e.g., methyl, ethyl, n-propyl, isopropyl, n-butyl, isobutyl, tert-butyl), an aryl group (preferably having from 6 to 12, more preferably from 6 to 10, and particularly preferably from 6 to 8, carbon atoms, e.g., phenyl, p-methylphenyl), an amino group (preferably having from 0 to 20, more preferably from 0 to 10, and particularly preferably from 0 to 6, carbon atoms, e.g., amino, methylamino, dimethylamino, diethylamino), an alkoxyl group (preferably having from 1 to 8, more preferably from 1 to 6, and particularly preferably from 1 to 4, carbon atoms, e.g., methoxy, ethoxy), an aryloxy group (preferably having from 6 to 12, more preferably from 6 to 10, and particularly preferably from 6 to 8, carbon atoms, e g., phenyloxy), an acyl group (preferably having from 2 to 12, more preferably from 2 to 10, and particularly preferably from 2 to 8, carbon atoms, e.g., acetyl), an alkoxycarbonyl group (preferably having from 2 to 12, more preferably from 2 to 10, and particularly preferably from 2 to 8, carbon atoms, e.g., methoxycarbonyl), an aryloxycarbonyl group (preferably having from 7 to 20, more preferably from 7 to 15, and particularly preferably from 7 to 10, carbon atoms, e.g., phenyloxycarbonyl) an acyloxy group (preferably having from 2 to 12, more preferably from 2 to 10, and particularly preferably from 2 to 8, carbon atoms, e.g., acetoxy), an acylamino group (preferably having from 2 to 10, more preferably from 2 to 6, and particularly preferably from 2 to 4, carbon atoms, e g., acetylamino), an alkoxycarbonylamino group (preferably having from 2 to 12, more preferably from 2 to 10, and particularly preferably from 2 to 8, carbon atoms, e.g., methoxycarbonylamino), an aryloxycarbonylamino group (preferably having from 7 to 20, more preferably from 7 to 12, and particularly preferably from 7 to 10, carbon atoms, e.g., phenyloxycarbonylamino), a sulfonylamino group (preferably having from 1 to 10, more preferably from 1 to 6, and particularly preferably from 1 to 4, carbon atoms, e. g., methanesulfonylamino) a sulfamoyl group (preferably having from 0 to 10, more preferably from 0 to 6, and particularly preferably from 0 to 4, carbon atoms, e.g., sulfamoyl, methylsulfamoyl), a carbamoyl group (preferably having from 1 to 10, more preferably from 1 to 6, and particularly preferably from 1 to 4, carbon atoms, e.g., carbamoyl, methylcarbamoyl), an alkylthio group (preferably having from 1 to 8, more preferably from 1 to 6, and particularly preferably from 1 to 4, carbon atoms, e.g., methylthio, ethylthio, carboxymethylthio), an arylthio group (preferably having from 6 to 20, more preferably from 6 to 10, and particularly preferably from 6 to 8, carbon atoms, e.g., phenylthio), a sulfonyl group (preferably having from 1 to 8, more preferably from 1 to 6, and particularly preferably from 1 to 4, carbon atoms, e.g., methanesulfinyl), a ureido group (preferably having from 1 to 8, more preferably from 1 to 6, and particularly preferably from 1 to 4, carbon atoms, e. g., ureido, methylureido), a hydroxyl group, a mercapto group, a cyano group, a sulfo group, a carboxyl group, a nitro group, a hydroxamic acid group, and a heterocyclic group (e.g., imidazolyl, pyridyl).

Of these organic ligands, preferred are bidentate ligands, more preferred are bidentate ligands capable of coordinating to metal ions by at least one oxygen atom (e.g., 8-oxyquinoline, diketones), and particularly preferred are diketone compounds. Of the diketone compounds, B-diketone compounds and γ-diketone compounds are preferred, and particularly preferred are β-diketone compounds.

Other ligands besides organic ligands can also be used in the present invention, e.g., $H_2O$, $NH_3$, CO, $N_2$, $NO_2$, NO, $CO_2$, $S_2$, $SO_3$, $N_2H_4$, $O_2$, $PH_3$ or arbitrary anions (e g., $Cl^{-}$, $NO_2^{-}$, $SCN^{-}$, $OCN^{-}$, $SeCN^{-}$, $TeCN^{-}$, $N_3^{-}$, $C(CN)_3^{-}$, $CH^{-}$) can be exemplified. However, since cyanide ions are not preferred from photographic point of view, they cannot be used as ligands.

The ligands of the optically active complexes of group A are preferably organic ligands, and the case where all the ligands coordinated to a metal ion are organic compounds is most preferred.

Specific examples of metal complexes of group A according to the present invention are shown below but the present invention is not limited thereto.

A-1. Δ-$Ru(acac)_3$ (acac: acetylacetonate)
A-2. Λ-$Ru(acac)_3$
A-3. Δ-$Rh(acac)_3$
A-4. Δ-$Co(acac)_3$
A-5. Λ-$Co(acac)_3$
A-6. Δ-$Co(TAA)_3$ (TAA: trifluoroacetylacetonate)
A-7. ΛΔ-$Co(TAA)_3$
A-8. Δ-$Co(dpm)_3$ (Hdpm: dipivaloylmethane)
A-9. Λ-$Co(dpm)_3$
A-10. fac-Δ-$[Co(L\text{-}ala)_3]$ (L-ala: L-alanine)
A-11. fac-Λ-$[Co(L\text{-}ala)_3]$
A-12. mer-Δ-$[Co(L\text{-}ala)_3]$
A-13. mer-Λ-$[Co(L\text{-}ala)_3]$
A-14. D-$[Co(D\text{-}pn)_3]^{3+}$ (D-pn: D-1,2-propylenediamine)
A-15. L-$[Co(D\text{-}pn)_3]^{3+}$
A-16. D-$[Co(phen)_3]^{2+}$ (phen: o-phenanthroline)
A-17. L-$[Co(phen)_3]^{2+}$
A-18. L-$[Ru(bpy)_3]^{2+}$
A-19. L-$[Co(bpy)_3]^{2+}$
A-20. L-$[Rh(bpy)_3]^{2+}$
A-21. L-$[Ir(bpy)_3]^{2+}$
A-22. L-$[Mn(bpy)_3]^{2+}$
A-23. Λ(+)-$[Co(en)_2(Me_2bpy)]^{3+}$ ($Me_2bpy$: 4,4'-dimethyl-2, 2'-bipyridine)
A-24. Λ-$[Co(C_2O_4^{2-})_3]^{3-}$
A-25. Λ-$[Co(C_2O_4^{2-})(en)_2]^{+}$ (en: ethylenediamine)
A-26. Δ-$Ru(Sacac)_3$ (Sacac: thioacetylacetonate)
A-27. Δ-$Co(Sacac)_3$
A-28. Δ-$Ru(SacSac)_3$ (SacSac: dithioacetylacetonate)
A-29. Δ-$Co(SacSac)_3$
A-30. Λ-$\{Co[(S,S)\text{-edds}]\}^{-}$ ((S,S)-$H_4$edds: (S,S)-ethylenediaminedisuccinic acid)
A-31. Δ-$\{Co[(S,S)\text{-edds}]\}^{-}$
A-32. Λ-$[Co(edta)]^{-}$ ($H_4$edta: ethylenediaminetetraacetic acid)
A-33. $(+)_{589}[Co(CO_3)(cyclen)]^{+}$
A-34. $\Delta(+)_{400}$-(N,S) $\{Co[(R)\text{-Mecys}]_3\}$ (Mecys: $NH_2CH(CO_2Me)CH_2S^{-}$)
A-35. $\Delta(+)_{400}$-(N,S) $\{Co[(R)\text{-cys}]_3\}^{3-}$ (cys: $[NH_2CH(CO_2^{-})CH_2S^{-}]_2$)
A-36. $(+)_{589}$-$\{ReO[H_2NCH(CO_2^{-})CH_2S^{-}](H_2NCH_2CH_2S^{-})\}$
A-37. $(+)_{589}$-$\{Cu[Cu[H_2NCH(CO_2^{-})CH_2S^{-}](en)\}$
A-38. $(+)_{589}$-$\{Au[H_2NCH(CO_2H)CH_2S^{-}](H_2NCH_2CH_2S^{31})\}^{-}$
A-39. $(+)_{589}$-$\{Pt[H_2NCH(CO_2H)CH_2S^{-}](H_2NCH_2CH_2S^{-})\}$
A-40. $(+)_{589}$-$\{Pd[H_2NCH(CO_2^{-})CH_2S^{-}](H_2NCH_2CH_2S^{31})\}^{-}$
A-41. Δ-$[Co(8\text{-oxyquinoline})_3]$
A-42. Λ-$[Ru(8\text{-oxyquinoline})_3]$ The complexes of group A according to the present invention may be synthesized as optically active complexes from the first, or synthesized as racemic bodies and then optically resolved. Complexes of group A can be synthesized according to several methods, e.g., they can be synthesized with referring to *Jikken Kagaku Koza* (*Experimental Chemistry Course*), 4th Ed., Vol. 17, "Muki Sakutai, Chelate Sakutai (Inorganic complexes, Chelate Complexes", Maruzen Co., Ltd., *Shin Jikken Kagaku koza* (*New Experimental Chemistry Course*), Vol. 08-3, "Muki Kagobutsu no Gosei (III) (Synthesis of Inorganic Compounds (III)", Maruzen Co., Ltd., *Shin Jikken Kagaku Koza* (*New Experimental Chemistry Course*), Vol. 11, "Sakuen Kagaku (Chemistry of Complex Salts)", Maruzen Co., Ltd., Coord. Chem. Rev. 84, pp. 85 to 277 (1988), and Kagehei Ueno, *Chelate Kagaku* (1)–(6) (*Chemistry of Chelate* (1)–(6)), Nankodo Publishing Co. Ltd.

The complexes of group A according to the present invention can be separated (optically resolved) by various methods, and these methods are specifically described, e.g., in Nihon Kagaku-kai compiled, *Shin Jikken Kagaku Koza* (*New Experimental Chemistry Course*), 8-III, 15 "Kogaku Bunkatsu-Ho (Methods of Optical Resolution)", Maruzen Co., Ltd. As one well-known method, a method of forming optically active organic acids (e.g., tartaric acid, bromocamphor sulfonic acid) and salts to complex cations and forming optically active organic bases (e.g., strychnine, cinchonine, brucine) and salts to complex anions and separating them can be exemplified. This is a method making use of the difference in physical properties between diastereomer. In addition, a method of utilizing chiral column or a mechanically separating method are exemplified.

In the next place, a metal complex of group B according to the present invention will be described in detail below.

Transition metals which the metal complex of group B may have include scandium, titanium, vanadium, chromium, manganese, iron, cobalt, nickel, copper, yttrium, zirconium, niobium, molybdenum, ruthenium, rhodium, palladium, silver, lanthanoid (lanthanum, cerium, praseodymium, neodymium, promethium, samarium, europium, gadolinium, terbium, dysprosium, holmium, erbium, thulium, ytterbium, lutetium), hafnium, tantalum, tungsten, rhenium, osmium, iridium, platinum and gold, and examples of typical metals include aluminum, zinc, gallium, germanium, cadmium, indium, tin, mercury, thallium and lead. Preferred examples include iron, ruthenium, manganese, cobalt, rhodium, iridium, copper, nickel, palladium, platinum, gold, zinc, titanium, chromium, molybdenum, and tungsten, more preferred are metal ions selected from ruthenium, cobalt, rhodium, iridium, and palladium, and particularly preferred is ruthenium.

Z in formula (I) represents an atomic group to form a 5- or 6-membered ring, e.g., a carbon atom, a nitrogen atom, an oxygen atom, or a sulfur atom can be exemplified, a preferred atomic group is a carbon atom or a nitrogen atom, and more preferred is a carbon atom. Z preferably forms a 6-membered ring.

The carbon atom or nitrogen atom represented by A may be the same or different. A preferably represents a carbon atom. A hydrogen atom may be or may not be attached to the atom represented by A.

The substituents of the organic ligands for forming the optically active complex of group A can be applied to the substituent represented by R in formula (I). Preferred examples of the substituents include an alkyl group, an amino group, an alkoxyl group, an acyl group, an acyloxy group, an acylamino group, a sulfonylamino group, a carbamoyl group, a sulfonyl group, a hydroxyl group, a mercapto group, a sulfo group, and a carboxyl group, more preferred substituents are an alkyl group, an amino group, an alkoxyl group, an acyl group, a hydroxyl group, a mercapto group, a sulfo group, and a carboxyl group. These substituents may further be substituted, or substituents may form a ring with each other.

In formula (I), the alkyl group represented by $R_1$ and $R_2$ is a straight chain or branched alkyl group having from 1 to 10 carbon atoms, preferably a straight chain alkyl group having from 1 to 4 carbon atoms, e.g., methyl, ethyl, and n-propyl can be exemplified, and these alkyl groups may further have substituents. Those exemplified as the substituents represented by R may be applied to such substituents. Preferably at least one of $R_1$ and $R_2$ represents an alkyl group, more preferably both $R_1$ and $R_2$ represent alkyl groups.

The ligand group represented by X is preferably $O^-$ or $COO^-$, and more preferably $O^-$.

The integers from 0 to 6 represented by n are preferably from 0 to 2, and more preferably 0 or 1.

The metal complexes of group B according to the present invention may be polynuclear complexes or mononuclear complexes, preferably mononuclear complexes. When the metal complexes have two or more metal ions, the metals present may be the same or different, preferably at least two metal ions are the same kind, and more preferably all the metal ions are the same kind.

The metal complexes of group B according to the present invention may have any conventionally known ligand other than the ligand represented by formula (I), e.g., the ligands described in *Comprehensive Coordination Chemistry,* Vol. 4, "Middle Transition Elements", pp. 1 to 1271, Pergamon Press, can be used. Preferred examples of such ligands are small molecules (e.g., $H_2O$, $NH_3$, CO, $N_2$, $NO_2$, NO, $CO_2$, $SO_2$, $SO_3$, $N_2H_4$, $O_2$, and $PH_3$), arbitrary organic compounds, or arbitrary anions (e.g., $Cl^-$, $NO_2^{31}$, $SCN^-$, $OCN^{31}$, $SeCN^-$, $TeCN^-$, $N_3^-$, $C(CN)_3^-$, or $CH^-$), and more preferably arbitrary organic compounds, a halogen atom and water.

The compound represented by formula (I) is preferably represented by formula (II), more preferably represented by formula (III), and particularly preferably represented by formula (IV).

(II)

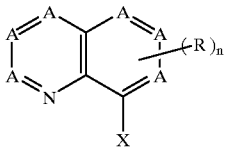

wherein A, R, X and n have the same meaning as those in formula (I) and the preferred ranges are also the same.

(III)

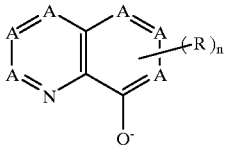

wherein A, R and n have the same meaning as those in formula (I) and the preferred ranges are also the same.

(IV)

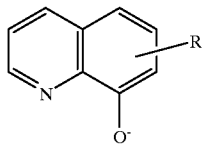

wherein R has the same meaning as that in formula (I) and the preferred range is also the same.

Specific examples of metal complexes of group B according to the present invention are shown below, but the present invention is not limited thereto.

B-1

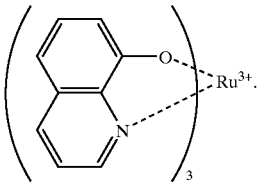

B-2

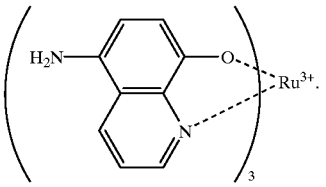

B-3

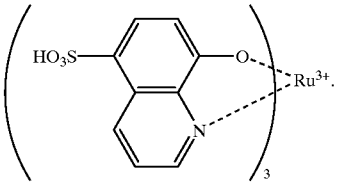

B-4

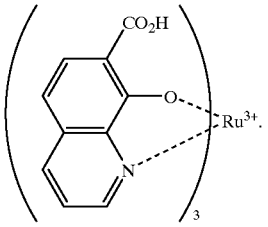

B-5

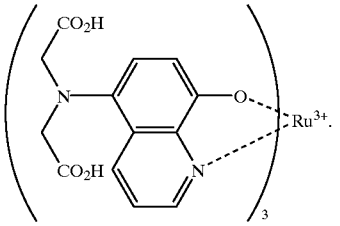

B-6

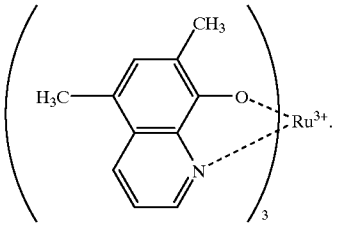

B-7

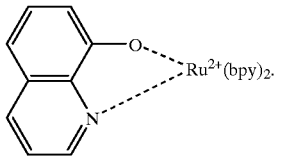

-continued

B-8

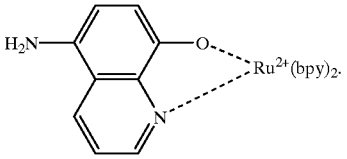

B-9

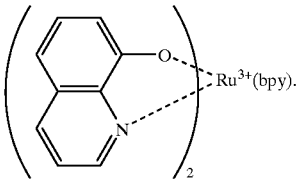

B-10

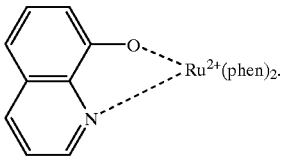

B-11

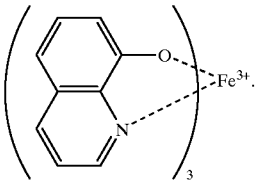

B-12

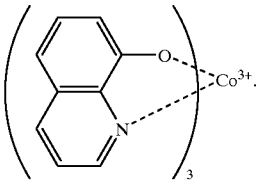

B-13

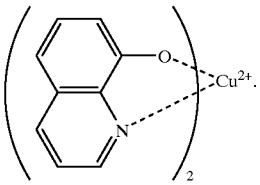

B-14

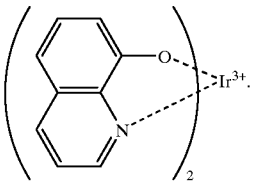

B-15

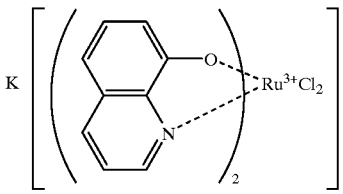

-continued

B-16

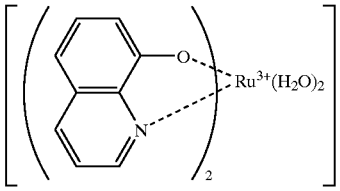

B-17

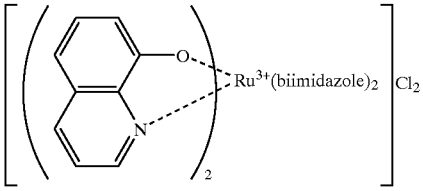

B-18

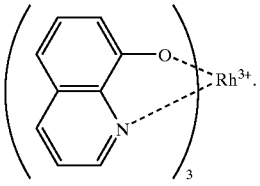

B-19

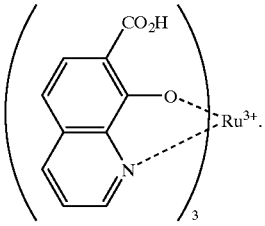

B-20

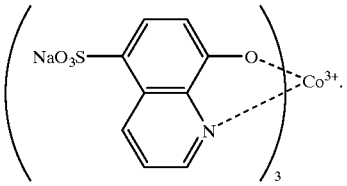

The compound represented by formula (I) can be synthesized according to the methods disclosed in the following references and patents: e.g., *Bull. Chem. Soc. Jpn.;* 27; 1954; 430, *Bull. Chem. Soc. Jpn.;* EN; 65; 2; 1992; 495–502, *Bull. Soc. Chim. Fr.;* 1947; 969, *Can. J. Chem.;* FR; 70; 11; 1992; 2828–2833, *Chem. Ber.;* 15; 1882; 684, *Chem. Ber.;* 19; 1886; 2469, *Chem. Ber.;* 20; 1887; 1218, 2690, *Chem. Ber.;* 49; 1916; 18, *Chem. Ber.;* 63; 1930; 2356, *Chem. Zentralbl.;* GE; 108; I; 1937; 3142, *Chem. Zentralbl.;* GE; 95; I; 1924; 572, *Chemosphere;* EN; 28; 6; 1994; 1097–1110, DE 14,976, DE 485,315, DE 579,226, DE 583,705, *Fresenius Z. Anal. Chem.;* 76; 1929; 196, *Helv. Chim. Acta;* 34; 1951; 427, 429, *Helv. Chim. Acta;* 8; 1925; 599, *Indian J. Chem. Sect.* B; EN; 37; 5; 1998; 429–432, *J. Pr. Inst. Chemists India;* 26; 1954; 21, *J. Amer. Chem. Soc.;* EN; 103; 16; 1981; 4884–4890, *J. Amer. Chem. Soc.;* EN; 111; 7; 1989; 2688–2691, *J. Chem. Soc.;* 1942; 415, *J. Chem. Soc.;* 1949; 3012, 3014, *J. Chem. Soc.;* 1952; 4985, 4989, *J. Chem. Soc.;* 1952; 4985, 4990, *J. Chem. Soc.;* 1952; 4985, 4991, *J. Chem. Soc.;* 1958; 3437, 3441, *J. Chem. Soc. Chem. Commun.;* EN; 1987; 1722–1724, *J. Chem. Soc. Perkin Trans.* 1; EN; 1980; 1933–1939, *J. Chem. Soc. Perkin Trans.* 1; EN; 9; 1993; 1065–1072, *J. Chem. Soc. Perkin Trans.* 2; EN; 12;

1995; 2227–2230, *J. Chem. Soc. Perkin Trans.* 2; EN; 2; 1994; 361–366, *J. Chem. Soc. Perkin Trans.* 2; EN; 9; 1983; 1327–1331, *J. Gen. Chem. USSR* (Engl. Transl.) ; EN; 52; 6; 1982; 1170–1175, *J. Indian Chem. Soc.;* 29; 1952; 711, *J. Indian Chem. Soc.;* EN; 59; 9; 1982; 1020–1021, *J. Indian Chem. Soc.;* EN; 61; 6; 1984; 471–473, *J. Indian Chem. Soc.;* EN; 62; 7; 1985; 552–553, *J. Indian Chem. Soc.;* EN; 62; 9; 1985; 705–707, *J. Indian Chem. Soc.;* EN; 69; 12; 1992; 852–853, *J. Mol. Struct.;* EN; 213; 1989; 133–144, *J. Org. Chem.;* 16; 1951; 438, 441, *J. Phys. Chem. B;* EN; 101; 14; 1997; 2650–2658, *J. Prakt. Chem.;* <2> 45; 1892; 530, *Monatsh. Chem.;* 1; 1880; 855, *Monatsh. Chem.;* 3; 1882; 536, *Naunyn-Schmiedeberg's Arch. Exp. Pathol. Pharmakol.;* 100; 1923; 57, *Phosphorus Sulfur Silicon Relat. Elem.;* EN; 106; 1–4; 1995; 137–144, *Russ. J. Phys. Chem.* (Engl. Transl.); EN; 66; 4; 1992; 463–465, *Sci. Cult.;* 16; 1951; 477, *Spectrochim. Acta Part A;* EN; 42; 4; 1986; 537–542, *Tetrahedron Lett.;* EN; 22; 47; 1981; 4733–4736, *Tetrahedron Lett.;* EN; 27; 36; 1986; 4253–4256, *Tetrahedron Lett.;* EN; 28; 33; 1987; 3809–3812, *Tetrahedron Lett.;* EN; 37; 37; 1966; 6695–6698, *Tetrahedron Lett.;* EN; 40; 10; 1999; 1985–1988, U.S. Pat. Nos. 1,966,026, 2,358,162, 2,489,530; 1948, *Z. Naturforsch. B Anorg. Chem. Org. Chem.;* GE; 37; 2; 1982; 236–245, *Zh. Obshch. Khim,;* 6; 1936; 63, 65.

Further, the complexes of group B according to the present invention can also be synthesized by some methods. For example, the methods described in, *Inorganica Chimica Acta,* 105, 205–208 (1985), G. Rodman et al., *Inorganic Chemistry,* 26, 4324–4331 (1987), G. K. Lahiri et al. can be referred to.

In the next place, a metal complex of group C will be described below. A metal complex of group C is a complex comprising a macrocyclic compound formed of a plurality of heterocyclic rings and metal ions, in particular, a porphyrin complex, a porphycene complex, a phthalocyanine complex, a chlorin complex, or a bacteriochlorin complex. The ligands of complexes used as dopants have been primarily cyanide ions such as yellow prussiate of potash (e.g., JP-B-48-35373) and heterocyclic rings such as 4,4'-bipyridine (e.g., JP-A-7-72569). In general, since a porphyrin complex, a porphycene complex, a phthalocyanine complex, a chlorin complex, and a bacteriochlorin complex are hardly soluble in water, they have not been used as a dopant in silver halide photographic materials. However, not only the problem of solubility has been solved by the introduction of a water-soluble group, but also the doping rate into silver halide grains can be raised in spite of the molecule becoming large, as a result, increasing sensitization can be realized. Considering that a smaller molecule or complex is in general more easily taken into silver halide grains, this is an unexpected result.

As the transition metals in which the metal complex of group C may have, the metals described in group B can be used, more preferred examples include iron, ruthenium, manganese, cobalt, rhodium, iridium, copper, nickel, palladium, platinum, gold, titanium, chromium, and osmium, still more preferred examples are iron, ruthenium, manganese, cobalt, rhodium, iridium, copper, nickel, and palladium, and particularly preferred are iron, ruthenium, cobalt, rhodium, and iridium.

Valency of the metal ions is not limited but is preferably a diamagnetic spin state.

A porphyrin complex, a porphycene complex, a phthalocyanine complex, a chlorin complex, and a bacteriochlorin complex may have other ligands at axial site and such ligands may be any of conventionally known ligands, e.g., those described in *Comprehensive Coordination Chemistry,* Vol. 4, "Middle Transition Elements", pp. 1 to 1271, Pergamon Press, can be used. Preferred examples of such ligands are inorganic compounds (e.g., $H_2O$, $NH_3$, CO, $N_2$, $NO_2$, NO, $CO_2$, $SO_2$, $SO_3$, $N_2H_4$, $O_2$, and $PH_3$) , organic compounds, or anions (e.g., $CN^-$, $Cl^-$, $NO_2^-$, $SCN^-$, $OCN^-$, $SeCN^-$, $TeCN^-$, $N_3^-$, $C(CN)_3^-$, or $CH^-$), and more preferred are inorganic compounds.

It may be that these ligands will be exchanged with other ligands at solution preparation, but it does not matter if they are exchanged, however, ligands which do not change the valencies of metals are preferred.

A porphyrin complex, a porphycene complex, a phthalocyanine complex, a chlorin complex, and a bacteriochlorin complex may have substituents, and as the substituents which may be directly substituted on the rings, the substituents of the organic ligands for forming the optically active complex of group A can be applied. Preferred examples of the substituents include an alkyl group, a phenyl group, a carboxyl group, a sulfo group, a phosphono group, a hydroxyl group, an acylamino group, a carbamoyl group, an alkoxycarbonylamino group, an aryloxycarbonylamino group, an amino group, a sulfonylamino group, a sulfamoyl group, a hydroxamic acid group, and a quaternary salt, and more preferred examples include an alkyl group, a carboxyl group, a sulfo group, a hydroxyl group, and a quaternary salt. These substituents may further be substituted.

A porphyrin complex, a porphycene complex, a phthalocyanine complex, a chlorin complex, and a bacteriochlorin complex preferably have at least one hydrophilic group. The hydrophilic group may be attached on the ring, or may be introduced as a further substituent of the substituent on the ring (e.g., carboxymethyl, hydroxyethyl, saccharides, etc.) The hydrophilic herein means any group capable of increasing the solubility in water, preferably a carboxyl group, a sulfo group, a phosphono group, a hydroxyl group, an acylamino group, a carbamoyl group, an alkoxycarbonylamino group, an aryloxycarbonylamino group, an amino group, a sulfonylamino group, a sulfamoyl group, a hydroxamic acid group, a quaternary salt, and an aldehyde group, more preferably a carboxyl group, a sulfo group, a hydroxyl group, and a quaternary salt (a quaternary ammonium salt, a pyridinium salt), and particularly preferably a carboxyl group, a hydroxyl group, and a quaternary salt (a quaternary ammonium salt, a pyridinium salt).

Of a porphyrin complex, a porphycene complex, a phthalocyanine complex, a chlorin complex, and a bacteriochlorin complex, the preferred order is a porphyrin complex>a chlorin complex>a bacteriochlorin complex>a porphycene complex>a phthalocyanine complex.

Preferred examples of porphyrin complexes, porphycene complexes, phthalocyanine complexes, chlorin complexes and bacteriochlorin complexes are shown below. Item (1) is the most preferred.

(1) A porphyrin complex, a porphycene complex, a phthalocyanine complex, a chlorin complex, and a bacteriochlorin complex containing metal ions selected from transition metallic elements belonging to period 4 to 6 and group III to XI of the Periodic Table, or typical metallic elements belonging to period 4 to 6 and group XII to XIV of the Periodic Table.

(2) A porphyrin complex having a hydrophilic group, a porphycene complex having a hydrophilic group, and a phthalocyanine complex having a hydrophilic group, each of which contains a metal ion selected from transition metallic elements belonging to period 4 to 6 and group III to XI of the Periodic Table, or typical metallic elements belonging to period 4 to 6 and group XII to XIV of the Periodic Table.

(3) A porphyrin complex having a hydrophilic group, a porphycene complex having a hydrophilic group, a phthalocyanine complex having a hydrophilic group, a chlorin complex having a hydrophilic group, and a bacteriochlorin complex having a hydrophilic group, each of which contains a metal ion selected from transition metallic elements belonging to period 4 to 6 and group III to XI of the Periodic Table.

(4) The porphyrin complex, the porphycene complex, the phthalocyanine complex, the chlorin complex, and the bacteriochlorin complex as described in the above item (3), wherein the hydrophilic group is a carboxyl group, a sulfo group, a hydroxyl group, or a quaternary salt (a quaternary ammonium salt, a pyridinium salt).

(5) The porphyrin complex, the porphycene complex, the phthalocyanine complex, the chlorin complex, and the bacteriochlorin complex as described in the above item (4), wherein the solubility in water of the complexes is 1 mM or more.

(6) The porphyrin complex, the porphycene complex, the phthalocyanine complex, the chlorin complex, and the bacteriochlorin complex as described in the above item (5), wherein the metal ion which the complexes have is iron, ruthenium, manganese, cobalt, rhodium, iridium, copper, nickel, palladium, platinum, gold, titanium, chromium, or osmium.

(7) The porphyrin complex, the porphycene complex, the phthalocyanine complex, the chlorin complex, and the bacteriochlorin complex as described in the above item (6), wherein the metal ion which the complexes have is iron, ruthenium, manganese, cobalt, rhodium, iridium, copper, nickel, or palladium.

(8) The porphyrin complex, the porphycene complex, the phthalocyanine complex, the chlorin complex, and the bacteriochlorin complex as described in the above item (7), wherein the metal ion which the complexes have is iron, ruthenium, cobalt, rhodium, or iridium.

(9) The porphyrin complex as described in the above item (8).

Specific examples of complexes of group C according to the present invention are shown below, but the present invention is not limited thereto.

C-1

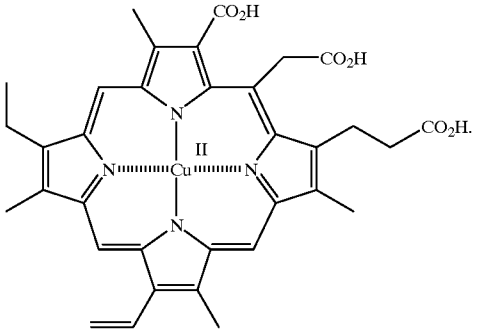

-continued

C-2

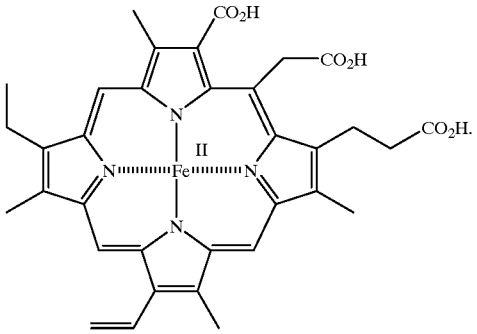

C-3

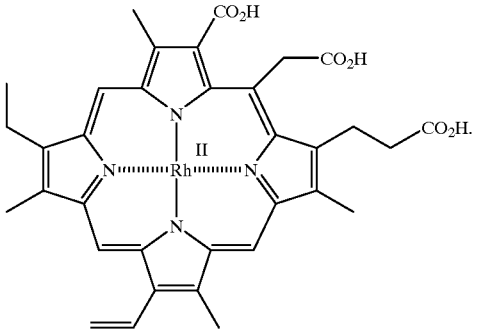

C-4

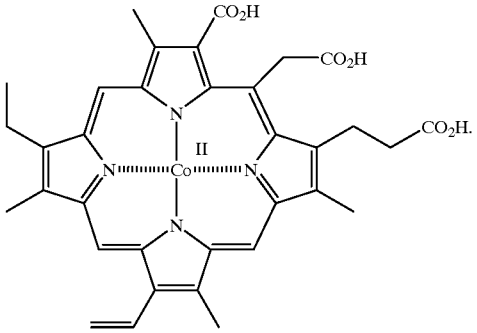

-continued
C-5
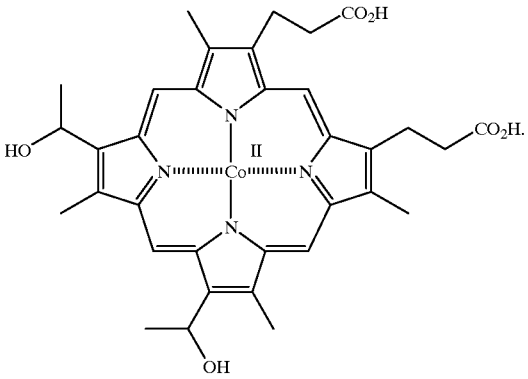
C-6
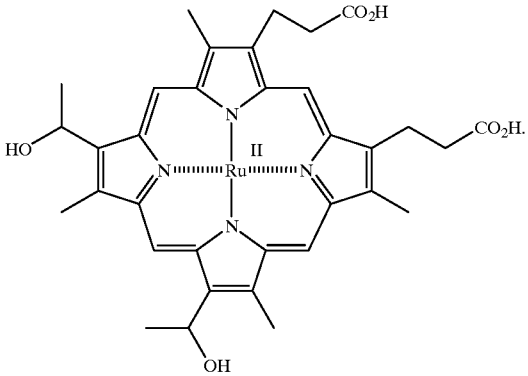
C-7
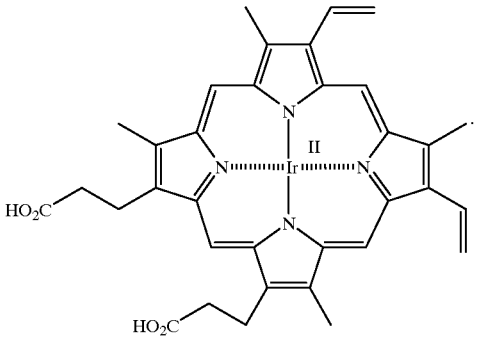
C-8
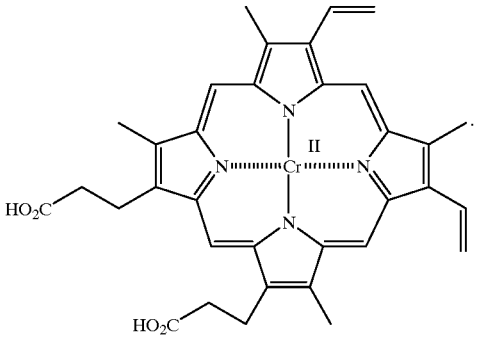
-continued
C-9
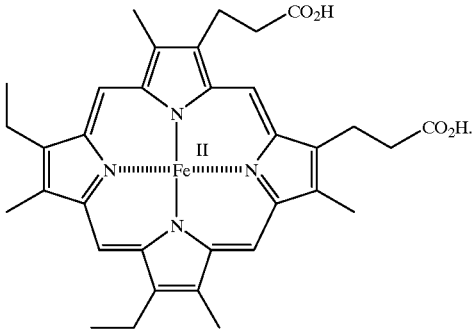
C-10
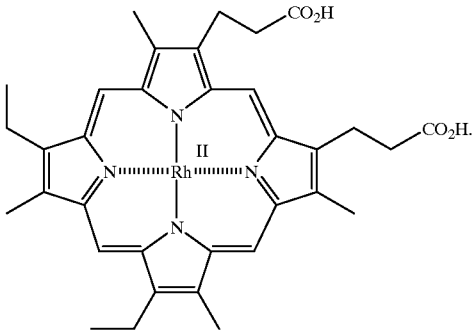
C-11
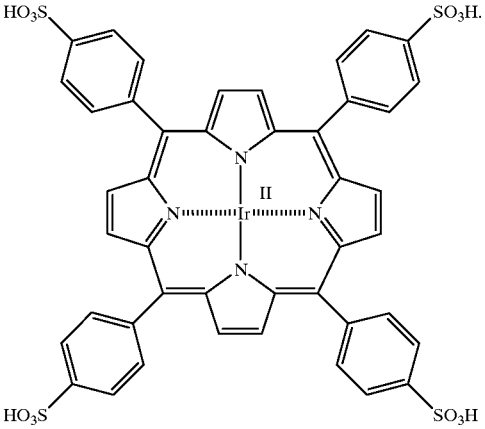
C-12
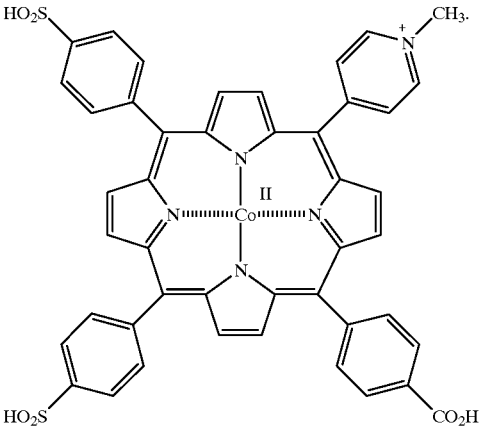

-continued
C-13
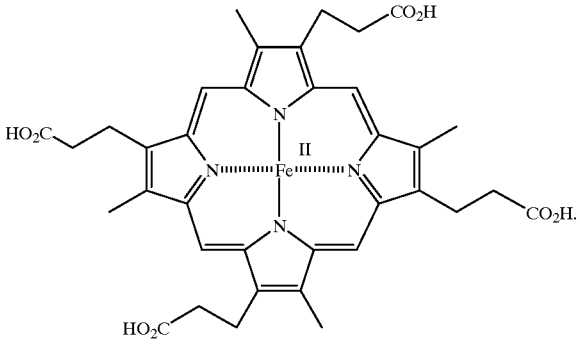
C-14
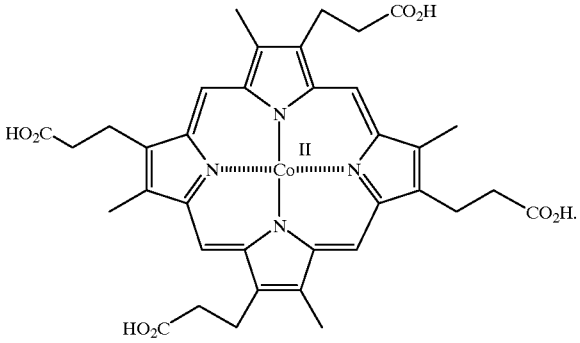
C-15
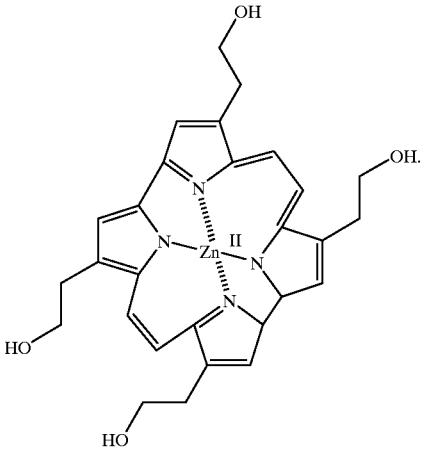
-continued
C-16
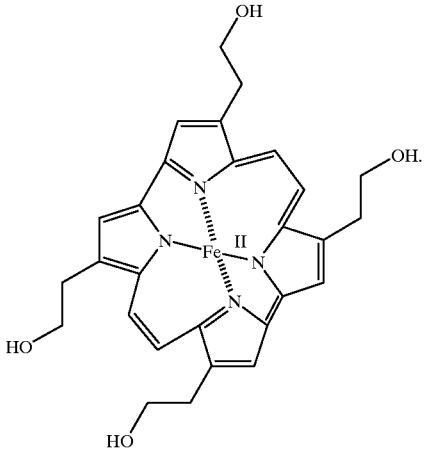
C-17
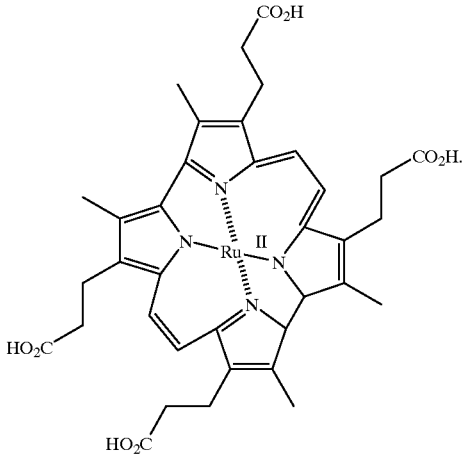
C-18
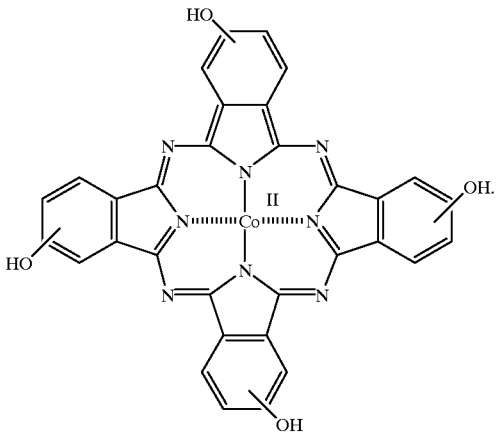

-continued
C-19
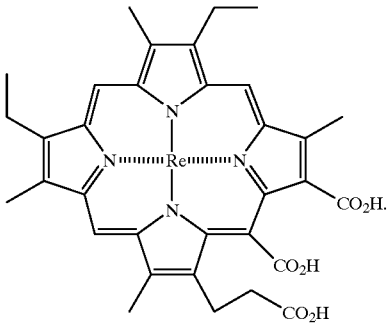
C-20
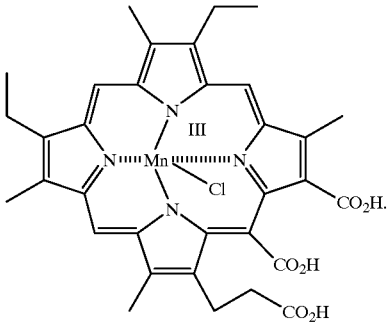
C-21
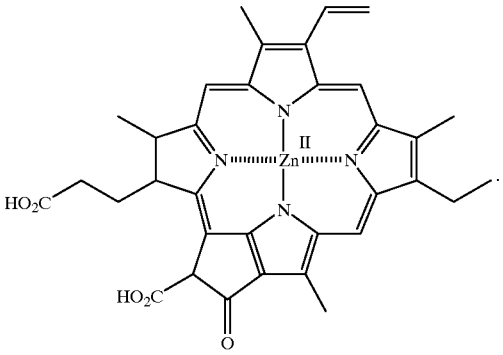
C-22
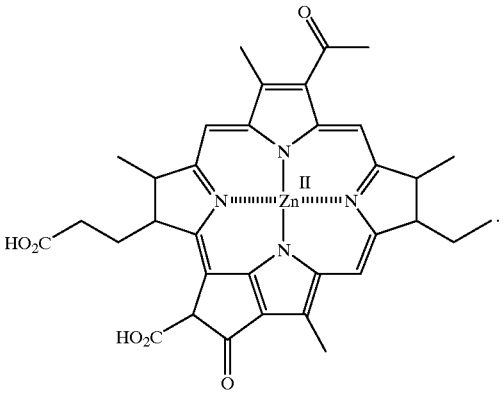
-continued
C-23
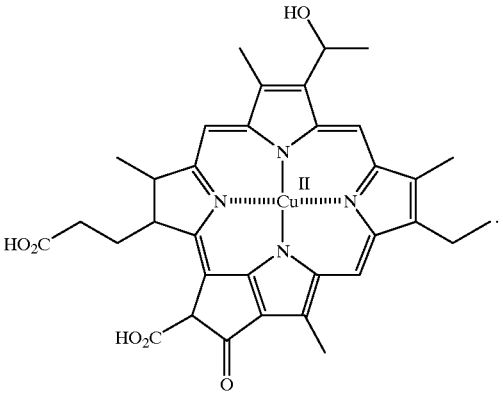
C-24
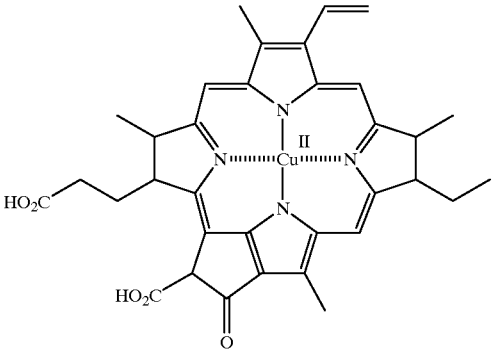
C-25
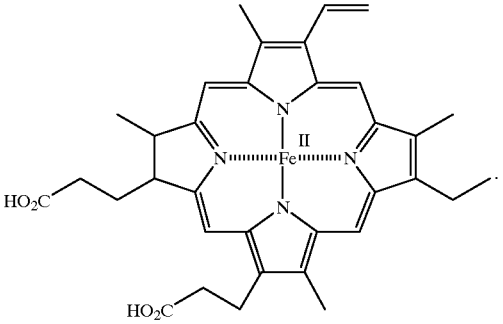
C-26
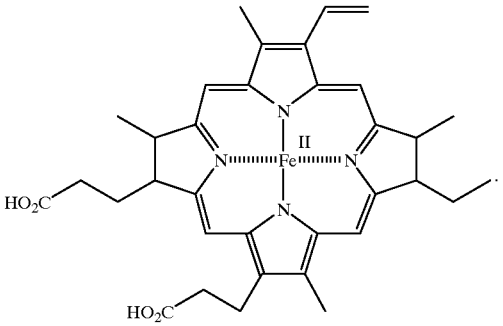

-continued

C-27

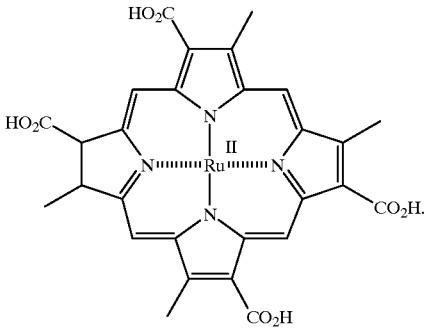

C-28

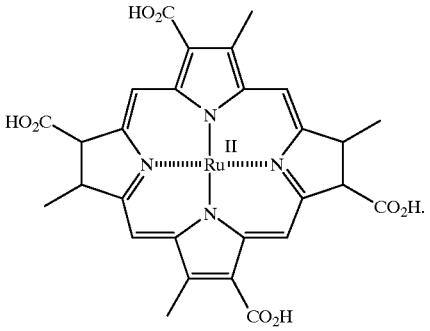

When the complex molecules to be doped in the present invention are cations, it is preferred that the counter anions thereof are those which are easily soluble in water and suitable for the precipitation operation of silver halide emulsions. Specifically, a halogen ion, a nitrate ion, a perchlorate ion, a tetrafluoroborate ion, a hexafluorophosphate ion, a tetraphenylborate ion, a hexafluorosilicate ion, a trifluoromethanesulfonate ion are preferably used. Further, when anions having high coordination tendency such as a cyano ion, a thiocyano ion, a nitrite ion, and a borate ion are used as counter anions, there is the probability of causing the ligand exchange reaction with the ligand of the complex of the present invention and the composition and the structure of the complex cannot be retained, hence these anions are not preferred.

A porphyrin ring, a porphycene ring, a phthalocyanine ring, a chlorin ring and a bacteriochlorin ring of group C and complexes thereof according to the present invention can be synthesized according to some methods. Such methods are described, e.g., in *Shin Jikken Kagaku Koza* (*New Experimental Chemistry Course*), Vol. 08-3, pp. 1501 to 1502, 1067, 1074, and 1497 to 1500, Maruzen Co., Ltd., *Jikken Kagaku Koza* (*Experimental Chemistry Course*) , 4th Ed., Vol. 17, pp. 26, 196, 385, 389, 395, 399, 400, 527 and 528, Maruzen Co., Ltd., *Jikken Kagaku Koza* (*Experimental Chemistry Course*), 4th Ed., Vol. 27, pp. 28 to 33. In addition, the following literature and patents can be referred to: *Inorganica Chimica Acta* (hereinafter abbreviated to *Inorg. Chimica Acta*), Vol. 156, No. 2, pp. 169 to 171 (1989), *Annalen der Chemie* (hereinafter abbreviated to *Ann. Chem.*), No. 506, pp. 196, 207 and 247 (1933) , *Ann. Chem.,* No. 486, pp. 107, 150 and 153 (1931), *Journal of the American Chemical Society* (hereinafter abbreviated to *J. Am. Chem. Soc.*), Vol. 72, pp. 491 and 493 (1950), *Z. Physiol. Chem.,* Vol. 246, pp. 15 and 19 (1937), DE 490,420, *Ann. Chem.,* Vol. 450, pp. 132, 136 and 148 (1926), *J. Am. Chem. Soc.,* Vol. 111, No. 8, pp. 3024–3029 (1989), *Journal of the Chemical Society, Perkin Transactions* 1 (hereinafter abbreviated to *J. Chem. Soc. Perkin Trans.* 1), pp. 1283 to 1289 (1980), *Tetrahedron Letters* (hereinafter abbreviated to *Tetrahedron Lett.*), Vol. 30, No. 45, pp. 6135 to 6138 (1989), *J. Chem. Soc. Perkin Trans.* 1, Vol. 11, pp. 1377 to 1386 (1920) , *J. Chem. Soc. Perkin Trans.* 1, Vol. 7, pp. 1945 to 1949 (1990), *Analytical Chemistry* (hereinafter abbreviated to *Anal. Chem.*), Vol. 65, No. 17, pp. 2189 to 2196 (1993), *Journal of the Indian Chemical Society* (hereinafter abbreviated to *J. Indian Chem. Soc.*), Vol. 58, pp. 1171 to 1172 (1981), *Helvetica Chimica Acta* (hereinafter abbreviated to *Helv. Chim. Acta*), Vol. 80, No. 6, pp. 1773 to 1801 (1997), *Tetrahedron,* Vol. 37, No. 21, pp. 3589 to 3601 (1981), *Acta Chemica Scandinavica* (hereinafter abbreviated to *Acta Chem. Scand.*), Vol. 4, pp. 1221 to 1224 (1950), *Ann. Chem.,* Vol. 537, pp. 250 to 271 (1939), and *Journal of Heterocyclic Chemistry* (hereinafter abbreviated to *J. Heterocycl. Chem.*), Vol. 16, pp. 191 to 192 (1979).

Besides the above-described metal complexes according to the present invention, metal complexes belonging to the following groups D, E and F can also be used.

Group D

A metal complex comprising a metal ion selected from transition metals belonging to period 4 to 6 and group III to XI of the Periodic Table, or typical metals belonging to period 4 to 6 and group XII to XIV of the Periodic Table, and at least one Schiff base ligand.

Group E

A polynuclear complex having an organic compound as a crosslinking ligand represented by the following formula (II):

$$\{L'_nM[L(ML'_m)_j]_k\}^l \quad \text{(II)}$$

wherein M represents an arbitrary metal or metal ion, and a plurality of M's may be a metal of the same kind or metals of different kinds; L represents a crosslinking ligand, which is an organic compound capable of crosslinking two or more metals or metal ions; L'represents a small molecule not electrically charged (e.g., $H_2O$, $NH_3$, CO, $N_2$, $NO_2$, $CO_2$, $SO_2$, $SO_3$, $N_2H_4$, $O_2$, or $PH_3$), an arbitrary organic compound, or an arbitrary inorganic anion, which may be the same or different chemical species, provided that when some of L' represent arbitrary inorganic anions, the inorganic anions respectively occupy the coordination site of less than half of the coordination site of one metal; n represents an integer of from 1 to 5; m represents an integer of from 0 to 5; j represents an integer of from 1 to 4; k represents an integer of 1 or more; and l represents the electric charge of the complex as a whole.

Group F

A metal complex comprising one or more metal (s) or metal ion(s) selected from transition metal elements belonging to period 4 to 6 and group III to XI of the Periodic Table, or typical metal elements belonging to period 4 to 6 and group XII to XIV of the Periodic Table, and at least each one of the N atom and the chalcogen atom of an organic compound as a coordination element.

Specific examples of complexes of groups E, E and F are shown below.

D-1

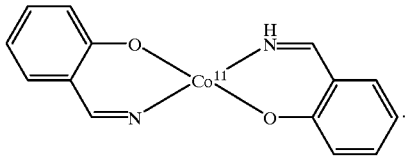

-continued

D-2

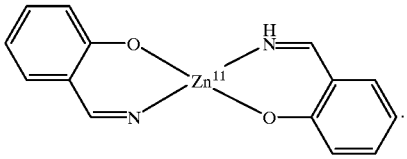

D-3

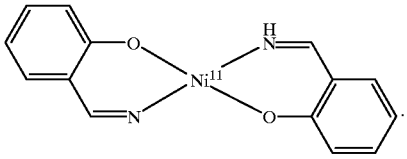

D-4

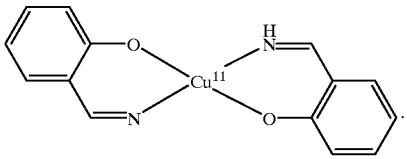

D-5

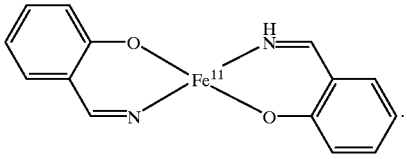

D-6

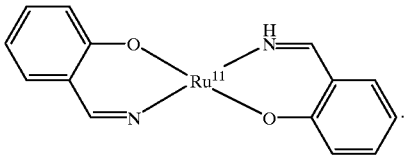

E-1

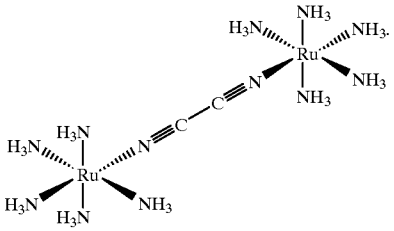

E-2

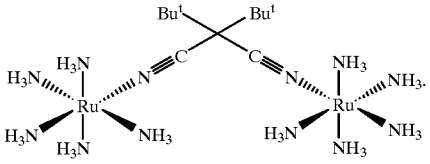

E-3

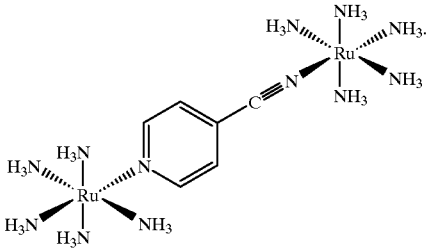

-continued

E-4

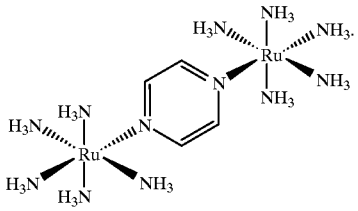

E-5

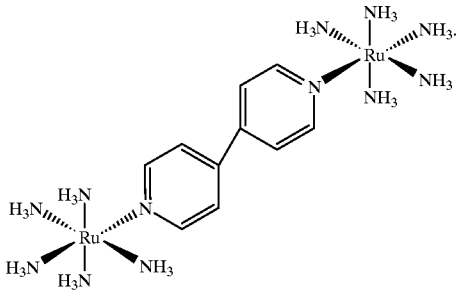

E-6

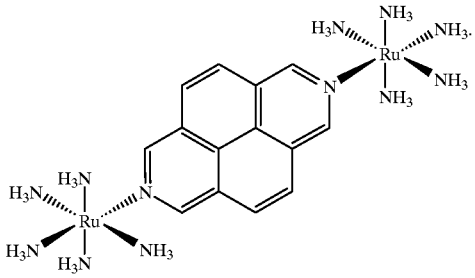

F-1. $\{Ru(H_2O)\ [S_2C_2(Ph)_2]\ (terpy)\ \}\ (CF_2SO_3)_2$ (terpy: terpyridine)

F-2. $[Ru(H_2O)\ (S_2C_7H_6)\ (terpy)]\ (CF_2SO_3)_2$

F-3. $K_3[Co(L\text{-}cys\text{-}N,S)_3]$ (L-cys$H_2$: L-cysteine, provided that L-cys means that two $H^+$ in L-cysteine are dissociated, and N,S means that the N atom and the S atom in L-cys coordinate to the metal ion, hereinafter the same)

F-4. $[Co(L\text{-}cys\text{-}N,S)_3Co(dien)]$ (dien: diethylenetriamine)

F-5. [Co(O,S-acen) (L-phe)] (L-pheH: L-phenylalanine, acen$H_2$: N,N'-ethylene-(acetylacetone-monothioacetylaceton diimine))

F-6. Na[Co(mpa) (trien)] (mpaH: mercaptopropionic acid, trien: triethylenetetramine)

For doping the complex according to the present invention into silver halide grains, the complex is preferably directly added to a reaction solution at silver halide grain formation, or added to an aqueous halide solution for forming silver halide grains or other solution in the first place and then added to the grain-forming reaction solution. Doping may be performed by combining these methods.

The complex according to the present invention may be doped uniformly in the inside of a silver halide grain, may be doped on the surface layer of a grain as disclosed in JP-A-4-208936, JP-A-2-125245 and JP-A-3-188437, or may be doped only in the inside of a grain and a layer which is not doped with the complex maybe added to the surface of a grain. Silver halide grains which only the surface layers are doped are preferably used in the present invention. Further, the surface of a grain may be reformed by the physical ripening of the silver halide fine grain doped with the complex as disclosed in U.S. Pat. Nos. 5,252,451 and 5,256,530. A method of preparing fine grains doped with the complex, adding the fine grains to silver halide grains and performing physical ripening to thereby dope the complex to the silver halide grains is also preferably used. The above doping methods may be used in combination.

The amount of a dopant is from $1\times10^{-9}$ to $1\times10^{-2}$ mol, preferably from $1\times10^{-7}$ to $1\times10^{-3}$ mol, per mol of the silver halide.

The silver halide emulsion for use in the silver halide photographic material according to the present invention is not particularly restricted and any of silver chloride, silver chlorobromide, silver bromide, silver iodochloride or silver iodobromide can be used, but an emulsion containing bromide ion or an iodide ion is preferred to a pure silver chloride emulsion. The grain size of silver halide grains are not restricted, and silver halide grains having an equivalent-sphere diameter of from 0.01 to 3 $\mu$m are preferably used. Silver halide grains in a photographic emulsion may have a regular crystal form or an irregular crystal form, but regular crystal grains are preferably used in the present invention. Regular crystal forms include a cubic, an octahedral, a dodecahedral, a tetradecahedral, an eicosahedral, and an octatetracontahedral form. Irregular crystal forms include a spherical and an ellipsoidal form. For doping the complex of the present invention, grains of a form having a plurality of twin planes may be used, and hexagonal tabular grains and triangular tabular grains having two or three parallel twin planes are preferably used. Tabular grains of monodispersed grain size distribution are more preferably used in the present invention. Monodispersed tabular grains are disclosed in JP-A-63-11928. Monodispersed hexagonal tabular grains are disclosed in JP-A-63-151618. Monodispersed circular tabular grains are disclosed in JP-A-1-131541. A monodispersed tabular grain emulsion 95% or more of the entire projected area of which is occupied by tabular grains having two twin planes parallel to the main plane is disclosed in JP-A-2-838. A tabular grain emulsion having the variation coefficient of a grain size of 10% or less which is prepared by a polyalkylene oxide block copolymer is disclosed in EP-A-514742. Monodispersed grains preferably used in the present invention can be produced by means of these techniques.

With respect to tabular grains, grains having {100} main planes and {111} main planes are known. Tabular grains having {100} main planes are disclosed in U.S. Pat. No. 4,063,951 and JP-A-5-281640 concerning silver bromide, and in EP-A-0534395 and U.S. Pat. No. 5,264,337 concerning silver chloride. Tabular grains having {111} main planes have various forms having one or more twin planes and are disclosed in U.S. Pat. Nos. 4,399,215, 4,983,508, 5,183,732, JP-A-3-137632 and JP-A-3-116113 concerning silver chloride. The dopant according to the present invention is preferably applied to tabular grains having {100} main planes and {111} main planes.

It is preferred for silver halide grains to have dislocation lines in the grains. The method for introducing dislocation lines into silver halide grains with controlling is disclosed in JP-A-63-220238. According to the description of JP-A-63-220238, dislocation lines can be introduced into a grain by providing a specific high iodide phase in the inside of a silver halide grain having the ratio of average grain size/grain thickness of 2 or more, and covering the outside of the high iodide phase with a phase having a lower iodide content. By the introduction of dislocation lines, the increase of sensitivity, the improvement of storage stability, the improvement of latent image stability, and the reduction of stress marks can be obtained. According to the above patent, dislocation lines are mainly introduced into the edge part of a tabular grain. The tabular grains having dislocation lines at the central part are disclosed in U.S. Pat. No. 5,238,796. Regular crystal grains having dislocation lines in the inside of the grains are disclosed in JP-A-4-348337. The same patent discloses that dislocation lines can be introduced into silver halide grains by forming epitaxy of silver chloride or silver chlorobromide in regular crystal grains and performing physical ripening of the epitaxy and/or conversion by halogen. Dislocation lines can be introduced into silver halide grains in the present invention by the method of providing a high iodide phase or the method of forming silver chlorobromide epitaxy, and by the introduction of dislocation lines, the increase of sensitivity and the reduction of stress marks can be obtained. The dislocation lines in silver halide grains can be observed by a direct method of using a transmission electron microscope at low temperature as described, e.g., in J. F. Hamilton, *Photo. Sci. Eng.,* Vol.11, p. 57 (1967) and T. Shiozawa, *J. Soc. Photo. Sci. JAPAN,* Vol. 35, p. 213 (1972). That is, a silver halide grain taken out of an emulsion carefully so as not to apply the pressure to generate dislocation lines is put on a mesh for electron microscopic observation, and dislocation lines of the grain are observed by a transmission method by keeping the sample in a refrigerated state so as to prevent the injury by electron beams (printout) The thicker the thickness of the grain, the more difficult would become the electron beams to transmit the grain, thus it is preferred for clear observation to use a high pressure electron microscope (200 kV or more to a thickness of 0.25 $\mu$m). The position and the number of dislocation lines of each grain observed vertically to the main plane can be obtained from the thus-obtained photograph of the grain. The effects of the present invention are exhibited when 50% or more in number of the silver halide grains have ten or more dislocation lines per one grain.

Additives which can be used in the preparation of a silver halide emulsion from the grain forming stage to the coating stage are not particularly limited. A silver halide solvent can be used for accelerating the growth of grains during the crystal forming stage and effectively performing chemical sensitization during grain forming stage and/or during chemical sensitization. As preferred silver halide solvents, water-soluble thiocyanate, ammonia, thioethers and thioureas can be used. Examples of silver halide solvents include thiocyanates (e.g., disclosed in U.S. Pat. Nos. 2,222,264, 2,448,534, and 3,320,069), ammonia, thioether compounds (e.g., in U.S. Pat. Nos. 3,271,157, 3,574,628, 3,704,130, 4,297,439, and 4,276,347), thione compounds (e.g., in JP-A-53-144319, JP-A-53-82408, and JP-A-55-77737), amine compounds (e.g., in JP-A-54-100717), thiourea derivatives (e.g., in JP-A-55-2982), imidazoles (e.g., in JP-A-54-100717), and substituted mercaptotetrazoles (e.g., in JP-A-57-202531)

In place of adding a silver salt solution and a halide solution to a reaction vessel, a method of adding previously prepared fine grains to a reaction vessel to cause nucleation and/or grain growth to thereby obtain silver halide grains is also preferably used. These techniques are disclosed in JP-A-1-183644, JP-A-1-183645, JP-A-2-44335, JP-A-2-43534, JP-A-2-43535 and U.S. Pat. No. 4,879,208. According to this method, the distribution of halogen ions in the emulsion grain crystals can be made completely uniform and preferred photographic characteristics can be obtained. Emulsion grains having various structures can be used in the present invention. Grains having so-called core/shell type double structure comprising a core part and a shell part, grains of triple structure (e.g., disclosed in JP-A-60-222844), and grains of multilayer structure may be used. When grains having structures in the interior of the grains are prepared, not only the above-described wrapping type structures but grains having conjugation structures can also be produced. Examples of such structures are disclosed in JP-A-58-108526, JP-A-59-16254, JP-A-59-133540, JP-B-58-24772 and EP-A-199290. The crystal to be conjugated can be grown by joining at the edge, corner or plane of a host crystal having different composition from that of a host crystal. Such a conjugated crystal can be grown when a host crystal has uniform halide composition or has core/shell type structure. In the case of the conjugated structure, the combination of silver halide and silver halide is of course possible but if silver salt compounds not having rock salt structure such as silver thiocyanate and silver carbonate can be joined with a silver salt and take conjugated grains, they can be used.

In cases of silver iodobromide grains having these structures, e.g., in core/shell type grains, the grains may comprise high silver iodide content core part and low silver iodide content shell part, or in contrast with this, the grains may comprise low silver iodide content core part and high silver iodide content shell part. Also, concerning the grains having conjugation structures, host crystals may have high silver iodide content and joined crystals may have relatively low silver iodide content, or vice versa. When the silver halide grains have either of the above described structures, the boundary between portions different in the halide compositions may be clear, or may be unclear because of mixed crystals formed due to difference in the halide composition. Further, the boundary may have sequential structural change provided positively. The silver halide emulsions for use in the present invention may be subjected to treatment for rounding the grains (e.g., disclosed in EP-B-0096727 and EP-B-0064412), or surface-reforming treatment (e. g., in German Patent 2,306,447 C2 and JP-A-60-221320). The silver halide emulsions for use in the present invention are preferably surface latent image type emulsions. However, as disclosed in JP-A-59-133542, internal latent image type emulsions may also be used by selecting a developing solution or developing conditions. In addition, shallow internal latent image type emulsions covered with a thin shell can be used according to purposes.

Silver halide emulsions are in general spectrally sensitized. Methine dyes are usually preferably used as a spectral sensitizing dye. Examples of methine dyes include a cyanine dye, a merocyanine dye, a complex cyanine dye, a complex merocyanine dye, a holopolar cyanine dye, a hemicyanine dye, a styryl dye, and a hemioxonol dye. Rings which are usually utilized as basic heterocyclic rings in cyanine dyes can be applied to these dyes. Examples of basic heterocyclic rings include a pyrroline ring, an oxazoline ring, a thiazoline ring, a pyrrole ring, an oxazole ring, a thiazole ring, a selenazole ring, an imidazole ring, a tetrazole ring, and a pyridine ring. Further, heterocyclic rings to which cyclic hydrocarbon rings and aromatic hydrocarbon rings are condensed can also be used. Examples of condensed rings include an indolenine ring, a benzindolenine ring, an indole ring, a benzoxazole ring, a naphthoxazole ring, a benzothiazole ring, a naphthothiazole ring, a benzoselenazole ring, a benzimidazole ring, and a quinoline ring. These rings may have a substituent on the carbon atoms. A 5- or 6-membered heterocyclic ring having a ketomethylene structure can be applied to a merocyanine dye or a complex merocyanine dye. Examples of such heterocyclic rings include a pyrazolin-5-one ring, a thiohydantoin ring, a 2-thiooxazolidine-2,4-dione ring, a thiazolidine-2,4-dione ring, a rhodanine ring, and a thiobarbituric acid ring.

A sensitizing dye is preferably added in an amount of from 0.001 to 100 mmol, more preferably from 0.01 to 10 mmol, per mol of silver halide. A sensitizing dye is preferably added during chemical sensitization or before chemical sensitization (e.g., during grain formation or physical ripening).

In the present invention, the sensitivity at the light having the wavelength of intrinsic absorption after chemical sensitization of silver halide grains (intrinsic sensitivity) is improved. That is, the desensitization due to the adsorption of spectral sensitizing dyes to the light of the wavelength longer than about 450 nm onto the surface of silver halide grains (intrinsic desensitization by sensitizing dyes) can be reduced by doping the complexes according to the present invention. The present invention has the effect of increasing the intrinsic sensitivity of silver halide, and the effect of capable of effectively preventing the intrinsic desensitization by sensitizing dyes as well.

A silver halide emulsion is in general chemically sensitized before use. As chemical sensitization, chalcogen sensitization (sulfur sensitization, selenium sensitization, tellurium sensitization), noble metal sensitization (gold sensitization) and reduction sensitization are used alone or in combination. In the present invention, the combination of sulfur sensitization and gold sensitization is preferably used as chemical sensitization but selenium sensitization and tellurium sensitization are also preferably used. In sulfur sensitization, labile sulfur compounds are used as a sulfur sensitizer. Labile sulfur compounds are described in P. Glafkides, *Chimie et Physique Photographique,* 5th Ed., Paul Montel (1987) and *Research Disclosure,* Vol. 307, No. 307105, T. H. James compiled, *The Theory of Photographic Process,* 4th Ed., Macmillan (1977), and H. Frieser, *Die Grundlagen der Photographischen Prozesse mit Silberhalogeniden,* Akademische Verlagsgesellschaft (1968). Examples of sulfur sensitizers include thiosulfates (e.g., sodium thiosulfate, p-toluenethiosulfonate), thioureas (e.g., diphenylthiourea, triethylthiourea, N-ethyl-N'-(4-methyl-2-thiazolyl)thiourea, carboxymethyltrimethylthiourea), thioamides (e.g., thioacetamide, N-phenylthioacetamide), rhodanines (e.g., rhodanine, N-ethylrhodanine, 5-benzylidenerhodanine, 5-benzylidene-N-ethylrhodanine, diethylrhodanine), phosphine sulfides (e.g., trimethylphosphine sulfide), thiohydantoins, 4-oxo-oxazolidine-2-thiones, dipolysulfides (e.g., dimorpholine disulfide, cystine, hexathiocanethione), mercapto compounds (e.g., cysteine), polythionate, and elemental sulfur. Active gelatins can also be used as a sulfur sensitizer.

In selenium sensitization, labile selenium compounds are used as a selenium sensitizer. Labile selenium compounds are disclosed in JP-B-43-13489, JP-B-44-15748, JP-A-4-25832, JP-A-4-109240, JP-A-4-271341, and JP-A-5-40324. Examples of selenium sensitizers include colloidal metal selenium, selenoureas (e.g., N,N-dimethylselenourea, trifluoromethylcarbonyltrimethylselenourea, acetyltrimethylselenourea), selenoamides (e.g., selenoacetamide, N,N-diethylphenyl-selenoamide), phosphineselenides (e.g., triphenylphosphineselenide, pentafluorophenyltriphenylphosphineselenide), selenophosphates (e.g., tri-p-tolylselenophosphate, tri-n-butylselenophosphate), seleno ketones (e.g., selenobenzophenone), isoselenocyanates, selenocarboxylic acids, seleno esters, and diacylselenides. In addition, comparatively stable selenium compounds such as selenious acid, potassium selenocyanide, selenazoles and selenides (disclosed in JP-B-46-4553 and JP-B-52-34492) can also be used as a selenium sensitizer.

Labile tellurium compounds are used as a tellurium sensitizer in tellurium sensitization. Labile tellurium compounds are disclosed in Canadian Patent 800,958, British Patents 1,295,462, 1,396,696, JP-A-4-204640, JP-A-4-271341, JP-A-4-333043, and JP-A-5-303157. Examples of tellurium sensitizers include telluroureas (e.g., tetramethyltellurourea, N,N'-dimethylethylenetellurourea, N,N'-diphenylethylenetellurourea), phosphinetellurides (e.g., butyl-diisopropylphosphinetelluride, tributylphosphinetelluride, tributoxyphosphinetelluride, ethoxydiphenylphosphinetelluride), diacyl( di)tellurides (e.g., bis(diphenyl carbamoyl)ditelluride, bis(N-phenyl-N-methylcarbamoyl) ditelluride, bis(N-phenyl-N-methylcarbamoyl)ditelluride, bis-(ethoxycarbonyl) telluride), isotellurocyanates (e.g., allyl-isotellurocyanate), telluro ketones (e.g., telluroacetone, telluroacetophenone), telluroamides (telluroacetamide, N,N-dimethyltellurobenzamide), tellurohydrazides, (e.g., N,N', N'-trimethyltellurobenzhydrazide), telluro esters (e.g., t-butyl-t-hexyltelluro ester), colloidal tellurium, (di) tellurides, and other tellurium compounds (e.g., potassium telluride, sodium telluropentathionate).

In noble metal sensitization, noble metal salts of gold, platinum, palladium, and iridium are used as a noble metal sensitizer. Noble metal salts are described in P. Glafkides, *Chimie et Physique Photographique,* 5th Ed., Paul Montel (1987) and *Research Disclosure,* Vol. 307, No. 307105. Gold sensitization is particularly preferred in the present invention. Examples of gold sensitizers include chloroauric acid, potassium chloroaurate, potassium aurithiocyanate, gold sulfide, and gold selenide, as well as gold compounds disclosed in U.S. Pat. Nos. 2,642,361, 5,049,484 and 5,049,485.

Reducing compounds are used as a sensitizer in reduction sensitization. Reducing compounds are disclosed in P. Glafkides, *Chimie et Physique Photographique,* 5th Ed., Paul Montel (1987), and *Research Disclosure, Vol.* 307, No. 307105. Examples of reducing compounds include aminoiminomethanesulfinic acid (thiourea dioxide), borane compounds (e.g., dimethylamine-borane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfite, aldehyde compounds, and hydrogen gas. Reduction sensitization can be carried out in the atmosphere of high pH and excessive silver ion (so-called silver ripening).

Chemical sensitization may be performed in combination of two or more. A combination of chalcogen sensitization with gold sensitization is particularly preferred. Reduction sensitization is preferably conducted during silver halide grain formation. The use amount of a sensitizer is in general determined according to the kind of silver halide grains to be used and the conditions of chemical sensitization. The use amount of a chalcogen sensitizer is generally from $1\times10^{-8}$ to $1\times10^{-2}$ mol, preferably from $1\times10^{-7}$ to $5\times10^{-3}$ mol, per mol of the silver halide. The use amount of a noble metal sensitizer is preferably from $1\times10^{-7}$ to $1\times10^{-2}$ mol per mol of the silver halide. The conditions of chemical sensitization are not particularly limited. pAg is in general from 6 to 11, preferably from 7 to 10, pH is preferably from 4 to 10, and temperature is preferably from 40 to 95° C., and more preferably from 45 to 85° C.

Various compounds can be added to a silver halide emulsion for preventing generation of fog or stabilizing photographic performances during production, storage or photographic processing of a photographic material. Examples of such compounds include azoles (e.g., benzothiazolium salt, nitroindazoles, triazoles, benzotriazoles, benzimidazoles (in particular, nitro- or halogen-substituted benzimidazoles); heterocyclic mercapto compounds (e.g., mercaptothiazoles, mercaptobenzothiazoles, mercaptobenzimidazoles, mercapto thiadiazoles, mercaptotetrazoles (in particular, 1-phenyl-5-mercaptotetrazoles) mercaptopyrimidines); the above heterocyclic mercapto compounds having a water-soluble group such as a carboxyl group or a sulfone group; thioketo compounds (e.g., oxazolinethione); azaindenes (e.g., tetraazaindenes (in particular, 4-hydroxy-substituted-(1,3,3a,7)tetraazaindene)); benzenethiosulfonic acid; and benzenesulfinic acid. These compounds are generally known as antifoggants or stabilizers.

Antifoggants or stabilizers are, in general, added after chemical sensitization. However, they may be added during chemical sensitization or before the beginning of chemical sensitization. That is, they can be added at any time during silver halide emulsion grain forming process, e.g., during addition of a silver salt solution, during the period after the addition and before the beginning of chemical sensitization, or during chemical sensitization (preferably within the time up to 50% from the start, more preferably within the time up to 20% from the start).

The layer constitution of a silver halide photographic material is not particularly limited. However, a color photographic material comprises a multilayer structure, as blue, green and red light are recorded separately. Each silver halide emulsion layer may consist of two layers of a high sensitivity layer and a low sensitivity layer. Examples of practical layer constitutions (1) to (6) are shown below.

(1) BH/BL/GH/GL/RH/RL/S
(2) BH/BM/BL/GH/GM/GL/RH/RM/RL/S
(3) BH/BL/GH/RH/GL/RL/S
(4) BH/GH/RH/BL/GL/RL/S
(5) BH/BL/CL/GH/GL/RH/RL/S
(6) BH/BL/GH/GL/CL/RH/RL/S

B represents a blue-sensitive layer, G a green-sensitive layer, R a red-sensitive layer, H the highest sensitivity layer, M a middle sensitivity layer, L a low sensitivity layer, S a support, and CL represents an interlayer effect imparting layer. Photo-insensitive layers such as a protective layer, a filter layer, an interlayer, an antihalation layer, and an undercoat layer are omitted. The arrangement of a high sensitivity layer and a low sensitivity layer having the same spectral sensitivity may be reversed. With respect to (3), U.S. Pat. No. 4,184,876 can be referred to, as to (4), in *Research Disclosure,* Vol. 225, No. 22534, JP-A-59-177551 and JP-A-59-177552, and as to (5) and (6) JP-A-61-34541 can be referred to, respectively. Preferred layer constitutions are (1), (2) and (4). Silver halide photographic material according to the present invention can also be applied to, besides color photographic materials, photographic materials for X-ray, black-and-white photographic materials, photographic materials for plate-making, and photographic paper.

With respect to various additives for use in silver halide emulsions (e.g., binders, chemical sensitizers, spectral sensitizers, stabilizers, gelatin, gelatin hardening agents, surfactants, antistatic agents, polymer latexes, matting agents, color couplers, ultraviolet absorbers, discoloration inhibitors, and dyes), supports of photographic materials and processing methods of photographic materials (e.g., coating methods, exposing methods, development processing methods), descriptions in *Research Disclosure,* Vol. 176, No. 17643 (RD 17643), ibid Vol. 187, No. 18716 (RD 18716) and ibid., Vol. 225, No. 22534 (RD 22534) can be referred to. Descriptions in *Research Disclosures* are listed in the following table.

| Type of Additives | RD 17643 | RD 18716 | RD 22534 |
|---|---|---|---|
| 1. Chemical Sensitizers | page 23 | page 648, right column | page 24 |
| 2. Sensitivity Increasing Agents | | page 648, right column | |
| 3. Spectral Sensitizers and Supersensitizers | pages 23–24 | page 648, right column to page 649, right column | pages 24–28 |
| 4. Brightening Agents | page 24 | | |
| 5. Antifoggants and Stabilizers | pages 24–25 | page 649, right column | pages 24 and 31 |
| 6. Light Absorbers, Filter Dyes, and Ultraviolet Absorbers | pages 25–26 | page 649, right column to page 650, left column | |
| 7. Antistaining Agents | page 25, right column | page 650, left to right columns | |
| 8. Dye image Stabilizers | page 25 | | page 32 |
| 9. Hardening Agents | page 26 | page 651, left column | page 32 |
| 10. Binders | page 26 | page 651, left column | page 28 |
| 11. Plasticizers and Lubricants | page 27 | page 650, right column | — |
| 12. Coating Aids and Surfactants | pages 26–27 | page 650, right column | — |
| 13. Antistatic Agents | page 27 | page 650, right column | — |
| 14. Color Couplers | page 25 | page 649 | page 31 |

Color photographic materials can be development processed according to ordinary methods described in *Research Disclosure,* Vol. 176, No. 17643, ibid., Vol. 187, No. 18716. Color photographic materials are in general subjected to washing processing or stabilization processing after development, blixing or fixation processing. Washing processing is usually performed in a countercurrent system by two or more tanks with a view to saving water. Instead of washing processing, multistage countercurrent stabilization processing as disclosed in JP-A-57-8543 is exemplified as representative stabilization processing.

EXAMPLE

The present invention will be described in detail with reference to specific examples but the present invention should not be construed as being limited thereto.

Example 1

Emulsion 1-1

Preparation of Silver Bromide Octahedral Grain Emulsion Sample

Thirty-six (36) grams of deionized gelatin and 0.25 g of potassium bromide were added to 870 ml of water and dissolved. To this aqueous gelatin solution were added, with stirring, 36 ml of a 0.088 M silver nitrate aqueous solution (solution 1) and 36 ml of a 0.088 M potassium bromide aqueous solution (solution 2) with maintaining the temperature at 75° C. by a double jet method for 10 minutes, and then 176 ml of solution land 176 ml of solution 2 were added by a double jet method for 7 minutes. Subsequently, 898 ml of a 0.82 M silver nitrate aqueous solution (solution 3) was added to the foregoing mixed solution at an initial flow rate of 0.53 ml/min with accelerating the flow rate for 90 minutes, and a 0.90 M potassium bromide aqueous solution (solution 4) was simultaneously added with controlling pBr to be maintained at 2.93. Thereafter, 90 ml of solution 3 was added to the mixed solution for 5 minutes, and an aqueous potassium bromide solution (solution 5) having the same concentration with solution 4 was simultaneously added with controlling pBr to be maintained at 2.93. Five minutes after the completion of addition, the temperature was lowered to 35° C., soluble salts were removed by ordinary flocculation, then the temperature was raised to 40° C., 50 g of gelatin was additionally added, further potassium bromide and 2-phenoxyethanol were added, and pH was adjusted to 6.5. The thus-obtained grains were monodispersed silver bromide octahedral grains having a side length of 0.5 $\mu$m.

Emulsions 1-2 to 1-6

Preparation of Silver Bromide Octahedral grain Emulsion Samples Doped with $K_4[Fe(CN)_6]$, $K_4[Ru(CN)_6]$, $Na_3[Fe(CN)_5$(2-mercaptobenzimidazole)], $K_2[Pd(CN)_4]$, or $Na_6[(CN)_5Fe$-4,4'-bipyridine-$Fe(CN)_5]$ (Comparative samples)

Each of emulsions 1-2 to 1-6 was prepared in the same manner as in the preparation of emulsion 1-1 except that each of $K_4[Fe(CN)_6]$, $K_4[Ru(CN)_6]$, $Na_3[Fe(CN)_5$(2-mercaptobenzimidazole)], $K_2[Pd(CN)_4]$, and $Na_6[(CN)_5Fe$-4,4'-bipyridine-$Fe(CN)_5]$ was added to solution 5 each in an amount of $1\times10^{-5}$ mol per mol of the silver to be added to this area. (As the amount of silver to be added to this area corresponded to 10% of the entire silver amount, each dopant added to the area came to 90% to 100% in grain volume (the surface layer up to 10% from the surface of a grain).)

Emulsions 1-7 to 1-12

Preparation of Silver Bromide Octahedral Grain Emulsion Samples Doped with Complexes of the Invention (Samples of the Invention)

Each of emulsions 1-7 to 1-12 was prepared in the same manner as in the preparation of Emulsion 1-1 except that each of Compounds B-1, B-3, B-4, B-7, B-11 and B-20 was added to solution 5 in an amount of $1\times10^{-5}$ mol per mol of the silver to be added to this area.

To each of the above-obtained silver bromide emulsions 1-1 to 1-12 were added sodium thiosulfate in an amount of 8. $0\times10^{-6}$ mol, chloroauric acid in an amount of $9.6\times10^{-6}$ mol, and potassium thiocyanate in an amount of $3.4\times10^{31\ 4}$ mol, each per mol of the silver, and each emulsion was optimally chemically sensitized at 60° C. Sensitizing Dye (1) having the structure shown below was added to each of the above chemically sensitized emulsions 1-1 to 1-12 in an amount of $4.9\times10^{-4}$ mol/mol of Ag and spectral sensitization was performed. Gelatin and sodium dodecylbenzenesulfonate were added to each emulsion. Each emulsion was extrusion-coated on a triacetyl cellulose film support having an undercoat layer together with a protective layer containing gelatin, polymethyl methacrylate particles and 2,4-dichloro-6-hydroxy-s-triazine sodium salt in a silver coating amount of 2 g/m$^2$. Thus, coated samples 1-1 to 1-12 were obtained.

Sensitizing Dye (1)

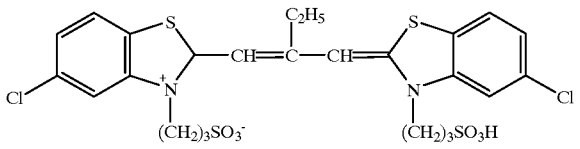

Each of these samples was subjected to sensitometric exposure (1 sec., $10^{-3}$ sec.) through an optical wedge, development processing using developing solution 1 having the composition shown below at 20° C. for 10 minutes, and then stopping, fixing, washing and drying by ordinary methods. Optical density of each sample was measured. The fog was obtained from the minimum optical density of each sample, and the sensitivity was expressed by the reciprocal of the exposure amount required to give the optical density of fog+0.1. Each value was expressed as a relative value with the value of the sample which was not doped as 100. The relative sensitivity obtained when each of coated samples 1-1 to 1-12 was exposed at the absorption wavelength of the spectral sensitizing dye is shown in Table 1.

| Developing Solution 1 | |
|---|---|
| Metol | 2.7 g |
| L-Ascorbic Acid | 11.0 g |
| Nabox | 36.0 g |
| KBr | 1.1 g |
| Water to make | 1 liter |
| pH adjusted to | 9.6 |

Photographic sensitivity of each emulsion to which the complex according to the present invention was doped to the layer accounting for 90 to 100% of silver halide grains in volume (the surface layer) was shown in Table 1. It was found that any of the emulsions doped with the dopants according to the present invention was highly sensitized as compared with those free of dopants. In particular, the emulsions doped with Compound B-1 and Compound B-20 according to the present invention showed higher effect of increasing sensitivity. $K_4[Ru(CN)_6]$ is disclosed in EP 33425 as a dopant effective for increasing sensitivity, $Na_3[Fe(CN)_5$(2-mercaptobenzimidazole)] in JP-A-11-102042, $K_2[Pd(CN)_4]$ in JP-A-11-109537, and $Na_6[(CN)_5Fe$-4,4'-bipyridine-$Fe(CN)_5]$ in U.S. Pat. No. 5,360,712, respectively. However, each of the emulsions doped with the compounds according to the present invention showed higher sensitivity than each emulsion doped with cyano complex of $Na_3[Fe(CN)_5$(2-mercaptobenzimidazole)], $K_2[Pd(CN)_4]$ or $Na_6[(CN)_5Fe$-4, 4'-bipyridine-$Fe(CN)_5]$. Each of the compounds according to the present invention rather showed a sensitivity level equal to or higher than that shown by $K_4[Fe(CN)_6]$ or $K_4[Ru(CN)_6]$.

Example 2

Emulsion 2-1

Preparation of Silver Bromide Octahedral Grain Emulsion Sample

A silver bromide octahedral grain emulsion 2-1 was prepared in the same manner as in the preparation of emulsion 1-1 in Example 1.

Emulsion 2-2

Preparation of Silver Bromide Octahedral Grain Emulsion Samples Doped with $K_4[Fe(CN)_6]$ (Comparative Samples)

Each of emulsions 2-2A and 2-2B was prepared in the same manner as in the preparation of emulsion 1-1 in

TABLE 1

| Sample No. | Emulsion No. | Dopant | Relative Sensitivity* 1 sec. Exposure | Relative Sensitivity* $10^{-3}$ sec. Exposure |
|---|---|---|---|---|
| 1-1 (Comparison) | 1-1 | None | 100 | 100 |
| 1-2 (Comparison) | 1-2 | $[Fe(CN)_6]^{4-}$ | 188 | 200 |
| 1-3 (Comparison) | 1-3 | $[Ru(CN)_6]^{4-}$ | 186 | 193 |
| 1-4 (Comparison) | 1-4 | $[Fe(CN)_5$(2-Mercaptobenzimidazole)$]^{3-}$ | 135 | 128 |
| 1-5 (Comparison) | 1-5 | $[Pd(CN)_4]^{2-}$ | 145 | 151 |
| 1-6 (Comparison) | 1-6 | $[(CN)_5Fe$-4,4'-Bipyridine-$Fe(CN)_5]^{6-}$ | 114 | 125 |
| 1-7 (Invention) | 1-7 | Compound B-1 of the Present Invention | 212 | 218 |
| 1-8 (Invention) | 1-8 | Compound B-3 of the Present Invention | 195 | 207 |
| 1-9 (Invention) | 1-9 | Compound B-4 of the Present Invention | 189 | 203 |
| 1-10 (Invention) | 1-10 | Compound B-7 of the Present Invention | 206 | 209 |
| 1-11 (Invention) | 1-11 | Compound B-11 of the Present Invention | 187 | 201 |
| 1-12 (Invention) | 1-12 | Compound B-20 of the Present Invention | 207 | 215 |

*The sensitivity of each sample was shown as a relative sensitivity with the sensitivity of sample 1-1 as 100.

Example 1 except that $K_4[Fe(CN)_6]$ was added to solution 5 each in an amount of $1\times10^{-4}$ mol or $5\times10^{-4}$ mol per mol of the silver to be added to this area.

Emulsion 2-3

Preparation of Silver Bromide Octahedral Grain Emulsion Samples Doped with Compound B-1 According to the Present Invention (Samples of the Invention)

Each of emulsions 2-3A and 2-3B was prepared in the same manner as in the preparation of emulsion 1-1 in Example 1 except that Compound B-1 was added to solution 5 each in an amount of $2\times10^{-5}$ mol or $1\times10^{-4}$ mol per mol of the silver to be added to this area.

Emulsion 2-4

Preparation of Silver Bromide Octahedral Grain Emulsion Samples Doped with Compound B-1 According to the Present Invention Uniformly in the Inside of the Grains (Samples of the Invention)

Each of emulsions 2-4A and 2-4B was prepared in the same manner as in the preparation of emulsion 1-1 in Example 1 except that Compound B-1 was added to solution 4 and solution 5 in an amount of $2\times10^{-5}$ mol or $1\times10^{-4}$ mol per mol of the silver to be added to these areas, respectively.

Emulsion 2-5

Preparation of Silver Bromide Octahedral Grain Emulsion Samples Doped with Compound B-1 According to the Present Invention in the Inside of the Grains (Samples of the Invention)

Each of emulsions 2-5A and 2-5B was prepared in the same manner as in the preparation of emulsion 1-1 in Example 1 except that Compound B-1 was added to solution 4 each in an amount of $2\times10^{-5}$ mol or $1\times10^{-4}$ mol per mol of the silver to be added to this area.

After each of the above-obtained silver bromide emulsions 2-1 and 2-2A to 2-5A was optimally chemically sensitized in the same manner as in Example 1, each emulsion was coated on a support in the same manner as in Example 1, thereby coated samples 2-1a to 2-5a were obtained. After emulsions 2-1 and 2-2B to 2-5B were optimally chemically sensitized in the same manner as above, Sensitizing Dye (1) used in Example 1 was added to each emulsion in an amount of $4.9\times10^{-4}$ mol per mol of Ag, and spectral sensitization was performed. The thus-obtained each emulsion was coated in the same manner as in coated samples 2-1a to 2-5a, thereby coated samples 2-1b to 2-5b were obtained.

Each of these samples was subjected to sensitometric exposure (1 sec., $10^{-3}$ sec.) through an optical wedge, development processing using developing solution 1 used in Example 1 at 20° C. for 10 minutes, and then stopping, fixing, washing and drying by ordinary methods. Optical density of each sample was measured. The fog was obtained from the minimum optical density of each sample, and the sensitivity was expressed by the reciprocal of the exposure amount required to give the optical density of fog+0.1. Each value was expressed as a relative value with the value of the sample which was not doped as 100. The relative sensitivity obtained when each of coated samples 2-1a to 2-5a (samples to which the spectral sensitizing dye was not added) was exposed at the wavelength of silver halide having intrinsic sensitivity, and the relative sensitivity obtained when each of coated samples 2-1b to 2-5b (samples to which the spectral sensitizing dye was added) was exposed at the wavelength of the sensitizing dye having an absorption band are respectively shown in Table 2.

TABLE 2

| Sample No.*1 | Emulsion No. | Dopant (area of doping, addition amount)*a | Relative Sensitivity*2 | |
|---|---|---|---|---|
| | | | 1 sec. Exposure | $10^{-3}$ sec. Exposure |
| 2-1a (Comparison) | 2-1 | None | 100 | 100 |
| 2-2a (Comparison) | 2-2A | $[Fe(CN)_6]^{4-}$ (surface, $1\times10^{-4}$ mol/mol Ag) | 130 | 132 |
| 2-3a (Invention) | 2-3A | Compound B-1 (surface, $2\times10^{-5}$ mol/mol Ag) | 159 | 172 |
| 2-4a (Invention) | 2-4A | Compound B-1 (homogeneously, $2\times10^{-5}$ mol/mol Ag) | 157 | 168 |
| 2-5a (Invention) | 2-5A | Compound B-1 (interior, $2\times10^{-5}$ mol/mol Ag) | 137 | 141 |
| 2-1b (Comparison) | 2-1 | None | 100 | 100 |
| 2-2b (Comparison) | 2-2B | $[Fe(CN)_6]^{4-}$ (surface, $5\times10^{-4}$ mol/mol Ag) | 349 | 422 |
| 2-3b (Invention) | 2-3B | Compound B-1 (surface, $1\times10^{-4}$ mol/mol Ag) | 449 | 468 |
| 2-4b (Invention) | 2-4B | Compound B-1 (homogeneously, $1\times10^{-4}$ mom/mol Ag) | 445 | 461 |
| 2-5b (Comparison) | 2-5B | Compound B-1 (interior, $1\times10^{-4}$ mol/mol Ag) | 361 | 422 |

*a The areas of doping of the emulsions shown in Table 2 are as follows. Surface: the surface area up to 10% from the grain surface in grain volume of from 90% to 100%, homogeneously: homogeneously in the grain, and interior: only the interior of the grain in grain volume of from 0 to 90% exclusive of the surface layer of the grain. The addition amount shown was the addition amount of the complex per mol of the silver and every silver amount added at emulsion preparation was shown.

*1 Sample Nos. attached with a means the samples to which the sensitizing dye was not added and those attached with b means the samples to which the sensitizing dye was added, and the samples attached with a was subjected to exposure with the intrinsic absorption wavelength of the silver bromide and b with the absorption wavelength of the dye.

*2 The sensitivity of each sample was shown as a relative sensitivity with the sensitivity of the samples prepared from emulsion 2-1 as 100.

The areas where dopants were added and the addition amounts as to Compound B-1 were examined in Example 2. In Table 2, the addition amount of each dopant, inclusive of $K_4[Fe(CN)_6]$ as a comparative sample, was changed from $1\times10^{-6}$ mol per mol of Ag to $5\times10^{-3}$ mol per mol of Ag, and the relative sensitivity obtained by the addition amount giving the maximum sensitivity at the doping area of each dopant is shown in Table 2 (the addition amount of the dopant was the addition amount of the complex per mol of the silver and every silver amount added at emulsion preparation was shown). In the case where no sensitizing dye was added, the emulsion doped with Compound B-1 according to the present invention on the surface showed the highest sensitivity, which was higher than the sensitivity of the emulsion obtained by doping with $K_4[Fe(CN)_6]$. On the other hand, in the case of emulsions containing the sensitizing dye, every emulsion doped with the dopant showed markedly high sensitivity when exposed with the absorption wavelength of the sensitizing dye. In particular, a conspicuously high effect of increasing sensitivity was shown in the emulsions doped on the surface and homogeneously with Compound B-1. In these emulsions, their sensitivities largely exceeded the maximum sensitivity of the highly sensitized emulsion doped with $K_4[Fe(CN)_6]$ in both cases of 1 sec. exposure and $10^{-3}$ sec. exposure.

Example 3

Emulsion 3-1

Preparation of Silver Bromide Octahedral Grain Emulsion Sample

Thirty-six (36) grams of deionized gelatin and 0.25 g of potassium bromide were added to 870 ml of water and dissolved. To this aqueous gelatin solution were added, with stirring, 36 ml of a 0.083 M silver nitrate aqueous solution (solution 1) and 36 ml of a 0.087 M potassium bromide aqueous solution (solution 2) with maintaining the temperature at 75° C. by a double jet method for 10 minutes, and then 176 ml of solution 1 and 176 ml of solution 2 were added by a double jet method for 7 minutes. Subsequently, 675 ml of a 0.82 M silver nitrate aqueous solution (solution 3) was added to the foregoing mixed solution at an initial flow rate of 1.8 ml/ min with accelerating the flow rate for 60 minutes, and a 0.83 M potassium bromide aqueous solution (solution 4) was simultaneously added with controlling pBr to be maintained at 2.93. Thereafter, 223 ml of solution 3 was added to the mixed solution for 25 minutes, and an aqueous potassium bromide solution (solution 5) having the same concentration with solution 4 was simultaneously added with controlling pBr to be maintained at 2.93. Five minutes after the completion of addition, the temperature was lowered to 35° C., soluble salts were removed by ordinary flocculation, then the temperature was raised to 40° C., 50 g of gelatin was additionally added, further potassium bromide and 2-phenoxyethanol were added, and pH was adjusted to 6.5. The thus-obtained grains were monodispersed silver bromide octahedral grains having a side length of 0.7 $\mu$m.

Emulsion 3-2

Preparation of Silver Bromide Octahedral Grain Emulsion Sample Doped with $K_4[Fe(CN)_6]$ (Comparative Sample)

Emulsion 3-2 was prepared in the same manner as in the preparation of emulsion 3-1 except that $K_4[Fe(CN)_6]$ was added to solution 5 in an amount of $2.5\times10^{-4}$ mol per mol of the silver to be added to this area. (As the amount of silver to be added to this area corresponded to 25% of the entire silver amount, the dopant added to the surface layer came to 75% to 100% in grain volume.)

Emulsions 3-3 to 3-5

Preparation of Silver Bromide Octahedral Grain Emulsion Samples Doped with $[Ru(bpy)_2Cl_2]$, $K[Pd(CN)_3(py)]$ or $K[Co(CN)_4(en)]$ (Comparative Samples)

Emulsions 3-3 to 3-5 were prepared in the same manner as in the preparation of emulsion 3-1 except that each of $[Ru(bpy)_2Cl_2]$ (bpy: 2,2'-bipyridine), $K[Pd(CN)_3(py)]$ (py: pyridine) and $K[Co(CN)_4(en)]$ (en: ethylenediamine) was dissolved in a 0.21 M KBr aqueous solution, and each of these complex solutions was added simultaneously with solution 3 and solution 4, and solution 3 and solution 5 by a triple jet method. The addition of each complex solution finished 15 minutes after the start of the addition of solution 5. The concentration of each of $[Ru(bpy)_2Cl_2]^0$, $K[Pd(CN)_3(py)]^-$ and $K[Co(CN)_4(en)]^-$ was $1\times10^{-4}$ mol per mol of the silver to be added to this area.

Emulsions 3-6 to 3-20

Preparation of Silver Bromide Octahedral Grain Emulsion Samples Doped with the Complexes of the Present Invention (Samples of the Invention)

Emulsions 3-6 to 3-20 were prepared in the same manner as in the preparation of emulsion 3-1 except that each compound according to the present invention shown in Table 3 was dissolved in a 0.21 M KBr aqueous solution, and each of these solutions was added simultaneously with solution 3 and solution 4, and solution 3 and solution 5 by a triple jet method. The addition of each complex solution finished 15 minutes after the start of the addition of solution 5. The concentration of each complex was $1\times10^{-4}$ mol per mol of the silver to be added to this area.

To each of the above-obtained silver bromide emulsions 3-1 to 3-20 were added sodium thiosulfate in an amount of $8.0\times10^{-6}$ mol, chloroauric acid in an amount of $9.6\times10^{-6}$ mol, and potassium thiocyanate in an amount of $3.4\times10^{-4}$ mol, each per mol of the silver, and each emulsion was optimally chemically sensitized at 60° C. Sensitizing Dye (1) used in Example 1 was added to each of the above chemically sensitized emulsions 3-1 to 3-20 in an amount of $4.9\times10^{-4}$ mol/mol of Ag and spectral sensitization was performed. Gelatin and sodium dodecylbenzenesulfonate were added to each emulsion. Each emulsion was extrusion-coated on a triacetyl cellulose film support having an undercoat layer together with a protective layer containing gelatin, polymethyl methacrylate particles and 2,4-dichloro-6-hydroxy-s-triazine sodium salt in a silver coating amount of 2 g/m$^2$. Thus, coated samples 3-1 to 3-20 were obtained.

Each of these samples was subjected to sensitometric exposure in the same manner as in Example 1. The relative sensitivity obtained when each of coated samples 3-1 to 3-20 was exposed at the absorption wavelength of the spectral sensitizing dye is shown in Table 3.

TABLE 3

| Sample No. | Emulsion No. | Dopant*1 | Relative*2 Sensitivity (1 sec. exposure) |
|---|---|---|---|
| 3-1 (Comparison) | 3-1 | None | 100 |
| 3-2 (Comparison) | 3-2 | $[Fe(CN)_6]^{4-}$ | 166 |
| 3-3 (Comparison) | 3-3 | $[Ru(bpy)_2Cl_2]^0$ | 116 |
| 3-4 (Comparison) | 3-4 | $[Pd(CN)_3(py)]^-$ | 126 |
| 3-5 (Comparison) | 3-5 | $[Co(CN)_4(en)]^-$ | 79 |
| 3-6 (Comparison) | 3-6 | $[Co(acac)_3]^0$ | 189 |
| 3-7 (Comparison) | 3-7 | $[Ru(acac)_3]^0$ | 172 |
| 3-8 (Invention) | 3-8 | Δ-$[Co(acac)_3]^0$ | 215 |
| 3-9 (Invention) | 3-9 | Λ-$[Co(acac)_3]^0$ | 215 |
| 3-10 (Invention) | 3-10 | Δ-$[Ru(acac)_3]^0$ | 195 |
| 3-11 (Invention) | 3-11 | Λ-$[Ru(acac)_3]^0$ | 193 |
| 3-12 (Invention) | 3-12 | fac-Δ-$[Co(L\text{-}ala)_3]$ | 204 |
| 3-13 (Invention) | 3-13 | L-$[Ru(bpy)_3]^{2+}$ | 197 |
| 3-14 (Invention) | 3-14 | L-$[Co(bpy)_3]^{2+}$ | 207 |
| 3-15 (Invention) | 3-15 | Λ(+)-$[Co(en)_2(Me_2bpy)]^{3+}$ | 206 |
| 3-16 (Invention) | 3-16 | Λ-$[Co(C_2O_4{}^{2-})_3]^{3-}$ | 199 |
| 3-17 (Invention) | 3-17 | Δ-$Co(Sacac)_3$ | 211 |
| 3-18 (Invention) | 3-18 | Λ-$[Co(edta)]^-$ | 197 |
| 3-19 (Invention) | 3-19 | Δ-$\{Co[(S,S)\text{-}edds]\}^-$ | 198 |
| 3-20 (Invention) | 3-20 | $(+)_{589}$-$\{ReO[H_2NCH(CO_2{}^-)CH_2S^-](H_2NCH_2CH_2S^-)\}$ | 195 |

*1The abbreviations for the ligands in these dopants are as follows: acac: acetylacetonate, L-ala: L-alanine, bpy: 2,2'-bipyridine, en: ethylenediamine, $Me_2bpy$: 4,4'-dimethyl-2,2'-bipyridine, Sacac: thioacetylacetonate, (S,S)-$H_4$edds: (S,S)-ethylenediaminedisuccinic acid, and $H_4$edta: ethylenediaminetetraacetic acid. Every optical purity of the complexes used was 80% ee or more.
*2The sensitivity of each sample was shown as a relative sensitivity with the sensitivity of sample 3-1 as 100.

Photographic sensitivity of each emulsion to which the complex according to the present invention was doped to the layer accounting for up to 90% in silver halide grain volume was shown in Table 3. It was found that any of the emulsions doped with the dopants of group A according to the present invention was highly sensitized as compared with those free of dopants, further each emulsion doped with the complex according to the present invention showed higher effect of increasing sensitivity than emulsions doped with dopants so far been used for increasing sensitivity, e.g., $[Ru(CN)_6]^{4-}$, and $[Ru(bpy)_2Cl_2]^0$ disclosed in JP-A-5-341426, $[Pd(CN)_3(py)]^-$ in JP-A-11-109537, and $[Co(CN)_4(en)]^-$ in U.S. Pat. No. 5,360,712, respectively. Further, optically active complexes of group A of the present invention (Λ body, Δ body, L body, and (+)body) have higher effect of increasing sensitivity as compared with optically inactive racemic body, and in the case where complexes have the same ligands, in particular, a Co complex showed higher effect than other metal complexes.

Example 4

Emulsion 4-1

Preparation of Silver Iodobromide Tabular Grain Emulsion Sample having {111} Main Planes One liter of a dispersion medium solution (pH: 5) containing 0.38 g of KBr and 0.5 g of low molecular weight gelatin (molecular weight: 15,000) was maintained at 40° C. To this dispersion medium solution were added, with stirring, 20 ml of a 0.29 M silver nitrate solution and 20 ml of a 0.29 M KBr solution by a double jet method for 40 seconds. After addition, the temperature of the dispersion medium solution was raised to 75° C. over 15 minutes, and a dispersion medium solution containing 35 g of alkali-processed gelatin and 250 ml of water was newly added to the above solution 15 minutes after the temperature had been raised. After the pH of the solution was adjusted to 6.0, 734 ml of a 1.2 M silver nitrate solution was added thereto with accelerating the flow rate. A mixed solution of a KBr solution and a KI solution was simultaneously added to the above solution so as to maintain pBr at 2.93 during the addition. At this time, the addition amount of the KI and KBr solution was the amount to reach 3 mol % of I based on the silver amount. The obtained grains had an average equivalent-circle diameter of the projected area of 1.12 μm. (variation coefficient: 16.2%), and an average thickness of 0.15 μm. An average equivalent-circle diameter of the projected area and an average thickness of grains can be obtained from an electron microphotograph of the grain according to the method disclosed in U.S. Pat. No. 4,434, 226.

Emulsions 4-2 and 4-3

Preparation of Silver Iodobromide Tabular Grain Emulsion Samples Doped with $[Ru(CN)_6]^{4-}$ or $[Ru(bpy)_2Cl_2]^0$ (Comparative Samples)

Emulsions 4-2 and 4-3 were prepared in the same manner as in the preparation of emulsion 4-1 except that to the area corresponding to 80 to 100% in grain volume was added $[Ru(CN)_6]^{4-}$ in an amount of $1\times10^{-4}$ mol, or $[Ru(bpy)_2Cl_2]^0$ in an amount of $2.5\times10^{-4}$ mol, each per mol of the silver of the entire grain.

Emulsions 4-4 and 4-5

Preparation of Silver Iodobromide Tabular Grain Emulsion Samples Doped with $[Co(acac)_3]^0$ (Racemic Body) or $[Ru(acac)_3]^0$ (Racemic Body) (Comparative Samples)

Emulsions 4-4 and 4-5 were prepared in the same manner as in the preparation of emulsion 4-1 except that to the area corresponding to 80 to 100% in grain volume was added $[Co(acac)_3]^0$ (racemic body) in an amount of $5\times10^{-5}$ mol, or $[Ru(acac)_3]^0$ (racemic body) in an amount of $5\times10^{-5}$ mol, each per mol of the silver of the entire grain.

Emulsions 4-6 to 4-11

Preparation of Silver Iodobromide Tabular Grain Emulsion Samples Doped with Δ-$[Co(acac)_3]^0$, Λ-$[Co(acac)_3]^0$, Δ-$[Ru(acac)_3]^0$, Λ-$[Ru(acac)_3]^0$, L-$[Co(bpy)_3]^{2+}$, or Δ-$[Co(Sacac)_3]$ (Samples of the Invention)

Emulsions 4-6 to 4-11 were prepared in the same manner as in the preparation of emulsion 4-1 except that to the area corresponding to 80 to 100% in grain volume was added each in an amount of $5\times10^{-5}$ mol of Δ-$[Co(acac)_3]^0$, Λ-$[Co(acac)_3]^0$, Δ-$[Ru(acac)_3]^0$, Λ-$[Ru(acac)_3]^0$, L-$[Co(bpy)_3]^{2+}$, or Δ-$[Co(Sacac)_3]$, each per mol of the silver of the entire grain.

To each of the above-obtained emulsions 4-1 to 4-11 were added sodium thiosulfate in an amount of $8.0\times10^{-6}$ mol, chloroauric acid in an amount of $3\times10^{-6}$ mol, and potassium thiocyanate, each per mol of the silver, and each emulsion was optimally chemically sensitized at 60° C. Each emulsion was coated on a support in the same manner as in Example 1. Each of these samples was subjected to sensitometric exposure ($10^{-2}$ sec.) through an optical wedge, development processing in the same manner as in Example 1, and then stopping, fixing, washing and drying by ordinary methods. Optical density of each sample was measured. The relative sensitivity obtained when each of coated samples 4-1 to 4-11 (samples to which the spectral sensitizing dye was not added) was exposed with the intrinsic absorption wavelength of the silver halide is shown in Table 4. Dmax of each sample after development processing was measured using red light (R light).

TABLE 4

| Sample No. | Emulsion No. | Dopant*1 | Addition Amount (mol/mol Ag) | Relative Sensitivity ($10^{-1}$ sec. exposure)*2 | Dmax |
|---|---|---|---|---|---|
| 4-1 (Comparison) | 4-1 | None | | 100 | 1.72 |
| 4-2 (Comparison) | 4-2 | $[Ru(CN)_6]^{4-}$ | $1\times10^{-4}$ | 105 | 1.81 |
| 4-3 (Comparison) | 4-3 | $[Ru(bpy)_2Cl_2]^0$ | $2.5\times10^{-4}$ | 106 | 1.80 |
| 4-4 (Comparison) | 4-4 | $[Co(acac)_3]^0$ | $5\times10^{-5}$ | 127 | 1.77 |
| 4-5 (Comparison) | 4-5 | $[Ru(acac)_3]^0$ | $5\times10^{-5}$ | 118 | 1.79 |
| 4-6 (Invention) | 4-6 | Δ-$[Co(acac)_3]^0$ | $5\times10^{-5}$ | 142 | 1.85 |
| 4-7 (Invention) | 4-7 | Λ-$[Co(acac)_3]^0$ | $5\times10^{-5}$ | 141 | 1.85 |
| 4-8 (Invention) | 4-8 | Δ-$[Ru(acac)_3]^0$, | $5\times10^{-5}$ | 131 | 1.86 |
| 4-9 (Invention) | 4-9 | Λ-$[Ru(acac)_3]^0$ | $5\times10^{-5}$ | 130 | 1.84 |
| 4-10 (Invention) | 4-10 | L-$[Co(bpy)_3]^{2+}$ | $5\times10^{-5}$ | 135 | 1.82 |
| 4-11 (Invention) | 4-11 | Δ-$[Co(Sacac)_3]$ | $5\times10^{-5}$ | 137 | 1.84 |

*1The abbreviations for the ligands in these dopants are as follows: acac: acetylacetonate, bpy: 2,2'-bipyridine, and Sacac: thioacetylacetonate. Every optical purity of the complexes used was 80% ee or more.

*2The sensitivity of each sample was shown as a relative sensitivity with the sensitivity of sample 4-1 as 100.

Δ-$[Co(acac)_3]^0$, Λ-$[Co(acac)_3]^0$, Δ-$[Ru(acac)_3]^0$, Λ-$[Ru(acac)_3]^0$, L-$[Co(bpy)_3]^{2+}$, and Δ-$[Co(Sacac)_3]$, which showed high effect of increasing sensitivity in silver bromide octahedral grain emulsions, were used as dopants. It was found that the emulsions doped with any of these dopants exhibited higher effect of increasing sensitivity than the emulsion doped with the dopant so far been used for increasing sensitivity, e.g., $[Ru(CN)_6]^{4-}$ or $[Ru(bpy)_2Cl_2]^0$. In particular, the emulsion doped with Δ-$[Co(acac)_3]^0$ or Λ-$[Co(acac)_3]^0$ showed the highest effect of improving sensitivity.

Further, when the surface of the silver halide grain of the emulsion doped with Δ-$[Co(acac)_3]^0$, Λ-$[Co(acac)_3]^0$, $[Co(acac)_3]^0$ (racemic body), $[Ru(CN)_6]^{4-}$or $[Ru(bpy)_2Cl_2]^0$ was observed with an electron microscope, it was confirmed that far more dislocation lines were introduced on the surface of the grain doped with Δ-$[Co(acac)_3]^0$ or Λ-$[Co(acac)_3]^0$ as compared with those doped with other complexes. It was also confirmed that big screw dislocation lines were introduced to some grains doped with $[Co(acac)_3]^0$ or Λ-$[Co(acac)_3]^0$.

Example 5

Emulsion 5-1

Preparation of Silver Bromide Octahedral Grain Emulsion Sample

Emulsion 5-1 was prepared in the same manner as in the preparation of emulsion 1-1 in Example 1. The obtained grains were monodispersed silver bromide octahedral grains having a side length of 0.5 μm.

Emulsions 5-2 to 5-6

Preparation of Silver Bromide Octahedral Grain Emulsion Samples Doped with $[Fe(CN)_6]^{4-}$, $[Ru(CN)_6]^{4-}$, $[Fe(CN)_5(2\text{-Mercaptobenzimidazole})]^{3-}$, $[Pd(CN)_4]^{2-}$, or $[(CN)_5Fe\text{-}4,4'\text{-Bipyridine-}Fe(CN)_5]^{6-}$ (Comparative Samples)

Each of emulsions 5-2 to 5-6 was prepared in the same manner as in the preparation of emulsion 1-1 except that each of $[Fe(CN)_6]^{4-}$, $[Ru(CN)_6]^{4-}$, $[Fe(CN)_5(2\text{-Mercaptobenzimidazole})]^{3-}$, $[Pd(CN)_4]^{2-}$, or $[(CN)_5Fe\text{-}4,4'\text{-Bipyridine-}Fe(CN)_5]^{6-}$ was added to solution 5 each in an amount of $1\times10^{-5}$ mol per mol of the silver to be added to this area. (As the amount of silver to be added to this area corresponded to 10% of the entire silver amount, each dopant added to the area came to 90% to 100% in grain volume (the surface layer up to 10% from the surface of a grain).)

Emulsions 5-7 to 5-13

Preparation of Silver Bromide Octahedral Grain Emulsion Samples Doped with Complexes of the Invention (Samples of the Invention)

Each of emulsions 5-7 to 1-13 was prepared in the same manner as in the preparation of Emulsion 1-1 except that each of Compounds C-2, C-6, C-10, C-16, C-18, C-25 or C-28 was added to solution 5 in an amount of $1\times10^{-5}$ mol per mol of the silver to be added to this area.

To each of the above-obtained silver bromide emulsions 5-1 to 5-13 were added sodium thiosulfate in an amount of $8.0\times10^{-6}$ mol, chloroauric acid in an amount of $9.6\times10^{-6}$ mol, and potassium thiocyanate in an amount of $3.4\times10^{-4}$ mol, each per mol of the silver, and each emulsion was optimally chemically sensitized at 60° C. Sensitizing Dye (1) in Example 1 was added to each of the above chemically sensitized emulsions 5-1 to 5-13 in an amount of $4.9\times10^{-4}$ mol/mol of Ag and spectral sensitization was performed. Gelatin and sodium dodecylbenzenesulfonate were added to each emulsion. Each emulsion was extrusion-coated on a triacetyl cellulose film support having an undercoat layer together with a protective layer containing gelatin, polymethyl methacrylate particles and 2,4-dichloro-6-hydroxy-s-triazine sodium salt in a silver coating amount of 2 g/m$^2$. Thus, coated samples 5-1 to 5-13 were obtained.

Each of these samples was subjected to sensitometry in the same manner as in Example 1. The relative sensitivity obtained when each of coated samples 5-1 to 5-13 was exposed at the absorption wavelength of the spectral sensitizing dye is shown in Table 5.

TABLE 5

| Sample No. | Emulsion No. | Dopant | Relative Sensitivity* 1 sec. Exposure | Relative Sensitivity* $10^{-3}$ sec. Exposure |
|---|---|---|---|---|
| 5-1 (Comparison) | 5-1 | None | 100 | 100 |
| 5-2 (Comparison) | 5-2 | $[Fe(CN)_6]^{4-}$ | 188 | 200 |
| 5-3 (Comparison) | 5-3 | $[Ru(CN)_6]^{4-}$ | 186 | 193 |
| 5-4 (Comparison) | 5-4 | $[Fe(CN)_5(2\text{-Mercaptobenzimidazole})]^{3-}$ | 135 | 128 |
| 5-5 (Comparison) | 5-5 | $[Pd(CN)_4]^{2-}$ | 145 | 151 |
| 5-6 (Comparison) | 5-6 | $[(CN)_5Fe\text{-}4,4'\text{-Bipyridine-}Fe(CN)_5]^{6-}$ | 114 | 125 |
| 5-7 (Invention) | 5-7 | Compound C-2 of the Present Invention | 211 | 207 |
| 5-8 (Invention) | 5-8 | Compound C-6 of the Present Invention | 203 | 201 |
| 5-9 (Invention) | 5-9 | Compound C-10 of the Present Invention | 197 | 195 |
| 5-10 (Invention) | 5-10 | Compound C-16 of the Present Invention | 190 | 186 |
| 5-11 (Invention) | 5-11 | Compound C-18 of the Present Invention | 189 | 183 |
| 5-12 (Invention) | 5-12 | Compound C-25 of the Present Invention | 205 | 199 |
| 5-13 (Invention) | 5-13 | Compound C-28 of the Present Invention | 201 | 196 |

*The sensitivity of each sample was shown as a relative sensitivity with the sensitivity of sample 5-1 as 100.

Photographic sensitivity of each emulsion to which the complex according to the present invention was doped to the layer accounting for 90 to 100% of silver halide grains in volume (the surface layer) was shown in Table 5. It was found that any of the emulsions doped with the dopants according to the present invention was highly sensitized as compared with those free of dopants. In particular, the emulsions doped with Compound C-2 and Compound C-6 according to the present invention showed higher effect of increasing sensitivity. $[Ru(CN)_6]^{4-}$ is disclosed in EP 33425 as a dopant effective for increasing sensitivity, $[Fe(CN)_5(2\text{-mercaptobenzimidazole})]^{3-}$ in JP-A-11-102042, $[Pd(CN)_4]^{4-}$ in JP-A-11-109537, and $[(CN)_5Fe\text{-}4,4'\text{-bipyridine-}Fe(CN)_5]^{6-}$ in U.S. Pat. No. 5,360,712, respectively. However, every emulsion doped with the compound according to the present invention showed higher sensitivity than that of each of the emulsions doped with these cyano complexes at low illuminance.

Example 6

Emulsion 6-1

Preparation of Silver Bromide Octahedral Grain Emulsion Sample

A silver bromide octahedral grain emulsion 6-1 was prepared in the same manner as in the preparation of emulsion 1-1 in Example 1.

Emulsion 6-2

Preparation of Silver Bromide Octahedral Grain Emulsion Samples Doped with $[Fe(CN)_6]^{4-}$ (Comparative Samples)

Each of emulsions 6-2A and 6-2B was prepared in the same manner as in the preparation of emulsion 1-1 in Example 1 except that $[Fe(CN)_6]^{4-}$ was added to solution 5 each in an amount of $1\times10^{-4}$ mol or $5\times10^{-4}$ mol per mol of the silver to be added to this area.

Emulsion 6-3

Preparation of Silver Bromide Octahedral Grain Emulsion Samples Doped with Compound C-2 According to the Present Invention (Samples of the Invention)

Each of emulsions 6-3A and 6-3B was prepared in the same manner as in the preparation of emulsion 1-1 in Example 1 except that Compound C-2 was added to solution 5 each in an amount of $2.5\times10^{-4}$ mol or $4\times10^{-4}$ mol per mol of the silver to be added to this area.

Emulsion 6-4

Preparation of Silver Bromide Octahedral Grain Emulsion Samples Doped with Compound C-2 According to the Present Invention Uniformly in the Inside of the Grains (Samples of the Invention)

Each of emulsions 6-4A and 6-4B was prepared in the same manner as in the preparation of emulsion 1-1 in Example 1 except that Compound C-2 was added to solution 4 and solution 5 in an amount of $5\times10^{-4}$ mol or $2.5\times10^{-4}$ mol per mol of the silver to be added to these areas, respectively.

Emulsion 6-5

Preparation of Silver Bromide Octahedral Grain Emulsion Samples Doped with Compound C-2 According to the Present Invention in the Inside of the Grains (Samples of the Invention)

Each of emulsions 6-5A and 6-5B was prepared in the same manner as in the preparation of emulsion 1-1 in Example 1 except that Compound C-2 was added to solution 4 each in an amount of $5\times10^{-4}$ mol or $1\times10^{-4}$ mol per mol of the silver to be added to this area.

After each of the above-obtained silver bromide emulsions 6-1 and 6-2A to 6-5A was optimally chemically sensitized in the same manner as in Example 1, each emulsion was coated on a support in the same manner as in Example 1, thereby coated samples 6-1a to 6-5a were obtained. After emulsions 6-1 and 6-2B to 6-5B were optimally chemically sensitized in the same manner as above, Sensitizing Dye (1) used in Example 1 was added to each emulsion in an amount of $4.9\times10^{-4}$ mol per mol of Ag, and spectral sensitization was performed. The thus-obtained each emulsion was coated in the same manner as in coated samples 6-1a to 6-5a, thereby coated samples 6-1b to 6-5b were obtained.

Each of these samples was subjected to sensitometric exposure (1 sec., $10^{-3}$ sec.) through an optical wedge, development processing using developing solution 1 used in Example 1 at 20° C. for 10 minutes, and then stopping, fixing, washing and drying by ordinary methods. Optical density of each sample was measured. The fog was obtained from the minimum optical density of each sample, and the sensitivity was expressed by the reciprocal of the exposure amount required to give the optical density of fog+0.1. Each value was expressed as a relative value with the value of the sample which was not doped as 100. The relative sensitivity obtained when each of coated samples 6-1a to 6-5a (samples to which the spectral sensitizing dye was not added) was exposed at the wavelength of silver halide having intrinsic sensitivity, and the relative sensitivity obtained when each of coated samples 6-1b to 6-5b (samples to which the spectral sensitizing dye was added) was exposed at the wavelength of the sensitizing dye having an absorption band are respectively shown in Table 6.

TABLE 6

| Sample No.*1 | Emulsion No. | Dopant (area of doping, addition amount)*a | Relative Sensitivity*2 | |
|---|---|---|---|---|
| | | | 1 sec. Exposure | $10^{-3}$ sec. Exposure |
| 6-1a (Comparison) | 6-1 | None | 100 | 100 |
| 6-2a (Comparison) | 6-2A | $[Fe(CN)_6]^{4-}$ (surface, $1\times10^{-5}$ mol/mol Ag) | 130 | 132 |
| 6-3a (Invention) | 6-3A | Compound C-2 (surface, $2.5\times10^{-5}$ mol/mol Ag) | 155 | 146 |
| 6-4a (Invention) | 6-4A | Compound C-2 (homogeneously, $5\times10^{-4}$ mol/mol Ag) | 148 | 141 |
| 6-5a (Invention) | 6-5A | Compound C-2 (interior, $4.5\times10^{-5}$ mol/mol Ag) | 134 | 134 |
| 6-1b | 6-1 | None | 100 | 100 |

TABLE 6-continued

| Sample No.*1 | Emulsion No. | Dopant (area of doping, addition amount)*a | Relative Sensitivity*2 1 sec. Exposure | $10^{-3}$ sec. Exposure |
|---|---|---|---|---|
| (Comparison) 6-2b (Comparison) | 6-2B | $[Fe(CN)_6]^{4-}$ (surface, $5 \times 10^{-5}$ mol/mol Ag) | 349 | 422 |
| 6-3b (Invention) | 6-3B | Compound C-2 (surface, $4 \times 10^{-5}$ mol/mol Ag) | 443 | 432 |
| 6-4b (Invention) | 6-4B | Compound C-2 (homogeneously, $2.5 \times 10^{-4}$ mol/mol Ag) | 435 | 426 |
| 6-5b (Comparison) | 6-5B | Compound C-2 (interior, $9 \times 10^{-5}$ mol/mol Ag) | 377 | 365 |

*aThe areas of doping of the emulsions shown in Table 6 are as follows. Surface: the surface area up to 10% from the grain surface in grain volume of from 90% to 100%, homogeneously: homogeneously in the grain, and interior: only the interior of the grain in grain volume of from 0 to 90% exclusive of the surface layer of the grain. The addition amount shown was the addition amount of the complex per mol of the silver and every silver amount added at emulsion preparation was shown.

*1Sample Nos. attached with a means the samples to which the sensitizing dye was not added and those attached with b means the samples to which the sensitizing dye was added, and the samples attached with a was subjected to exposure with the intrinsic absorption wavelength of the silver bromide and b with the absorption wavelength of the dye.

The areas where dopants were added and the addition amounts as to Compound C-2, the dopant showing the highest sensitivity in Example 5, were examined. In Table 6, the addition amount of each dopant, inclusive of $[Fe(CN)_6]^{4-}$ as a comparative sample, was changed from $1\times10^{-6}$ mol per mol of Ag to $5\times10^{-4}$ mol per mol of Ag, and the relative sensitivity obtained by the addition amount giving the maximum sensitivity at the doping area of each dopant is shown in Table 6 (the addition amount of the dopant was the addition amount of the complex per mol of the silver and every silver amount added at emulsion preparation was shown). In the case where no sensitizing dye was added, the emulsion doped with Compound C-2 according to the present invention on the grain surface showed the highest sensitivity, which was higher than the sensitivity of the emulsion obtained by doping with $[Fe(CN)_6]^{4-}$. On the other hand, in the case of emulsions containing the sensitizing dye, every emulsion doped with the dopant showed markedly high sensitivity when exposed with the absorption wavelength of the sensitizing dye. In particular, a conspicuously high effect of increasing sensitivity was shown in the emulsions doped on the grain surface with Compound C-2 and the emulsions doped homogeneously in the inside of the grain with Compound C-2, above all, particularly remarkable effect was confirmed in the emulsions doped on the grain surface. In these emulsions, the sensitivities largely exceeded the maximum sensitivity of the highly sensitized emulsion doped with $[Fe(CN)_6]^{4-}$ in both cases of 1 sec. exposure and $10^{-3}$ sec. exposure.

Example 7

Emulsion 7

Preparation of Silver Bromide Octahedral Grain Emulsion Sample Doped with Compound C-2 According to the Present Invention Homogeneously in the Grains Emulsion 6-4A obtained in Example 6 was optimally chemically sensitized and then spectrally sensitized, and this emulsion was used as the emulsion in the third layer of the photosensitive sample No. 201 in Example 2 of JP-A-9-146237 and the same processing was performed as in Example 2 of JP-A-9-146237. Good result was obtained.

Example 8

An aqueous solution (1.0 M) was prepared using $K_4[Fe(CN)_6]$, $Na_6[(CN)_5Fe\text{-}4,4'\text{-bipyridine-}Fe(CN)_5]$ or Compound C-2 according to the present invention with pure water not deaerated. Spectral absorption spectra of each aqueous solution aged for 6 hours, 12 hours and 24 hours were measured and the residual amount of each compound was computed. The residual amounts (%) due to aging taking fresh solutions as 100% are shown below.

| | After 6 Hours | After 12 Hours | After 24 Hours |
|---|---|---|---|
| $K_4[Fe(CN)_6]$ | 91% | 85% | 74% |
| $Na_6[(CN)_5Fe\text{-}4,4'\text{-bipyridine-}Fe(CN)_5]$ | 63% | 27% | 8% |
| Compound C-2 | 97% | 95% | 94% |

The compound according to the present invention was proved to be excellent in aging stability after preparation of a solution.

Example 9

Silver halide tabular grains were prepared (tabular grains 60% or more of the entire projected area of which have an aspect ratio of 8) with referring to the example of JP-A-1-158426 and the description of JP-A-3-237450. Using these tabular grains, emulsions doped with Compound C-2 according to the present invention on the grain surface, homogeneously in the grain and in the inside of the grain were prepared in the same manner as in Example 2 of the present invention. The emulsions were spectrally sensitized, and they were used as the emulsion in the third layer of the photosensitive sample No. 201 in Example 2 of JP-A-9-146237 and the same processing was performed as in Example 2 of JP-A-9-146237. Good result was obtained.

Example 10

Emulsion 10-1

Preparation of Silver Iodobromide Tabular Grain Emulsion Sample Having {111} Main Planes One liter of a dispersion medium solution (pH: 5) containing 0.38 g of KBr and 0.5 g of low molecular weight gelatin (molecular weight: 15,000) was maintained at 40° C. To this dispersion medium solution were added, with stirring, 20 ml of a 0.29 M silver nitrate solution and 20 ml of a 0.29 M KBr solution by a double jet method for 40 seconds. After addition, the temperature of the dispersion medium solution was raised to 75° C. over 15 minutes, and a dispersion medium solution containing 35 g of alkali-processed gelatin and 250 ml of water was newly added to the above solution 15 minutes after the temperature had been raised. After the pH of the solution was adjusted to 6.0, 734 ml of a 1.2 M silver nitrate solution was added thereto with accelerating the flow rate. A mixed solution of a KBr solution and a KI solution was simultaneously added to the above solution so as to maintain pBr at 2.93 during the addition. At this time, the addition amount of the KI and KBr solution was the amount to reach 3 mol % of $I^-$ based on the silver amount. The obtained grains had an average equivalent-circle diameter of the projected area of 1.12 μm (variation coefficient: 16.2%), and an average thickness of 0.15 μm. An average equivalent-circle diameter of the projected area and an average thickness of grains can be obtained from an electron microphotograph of the grain according to the method disclosed in U.S. Pat. No. 4,434, 226.

Emulsions 10-2 and 10-3

Preparation of Silver Iodobromide Tabular Grain Emulsion Samples Doped with $[Fe(CN)_6]^{4-}$ or $[Ru(CN)_6]^{4-}$ (Comparative Samples)

Emulsions 10-2 and 10-3 were prepared in the same manner as in the preparation of emulsion 10-1 except that to the area corresponding to 80 to 100% in grain volume was added $[Fe(CN)_6]^{4-}$ in an amount of $1\times10^{-4}$ mol, or $[Ru(CN)_6]^{4-}$ in an amount of $1\times10^{-4}$ mol, each per mol of the silver of the entire grain. ps Emulsions 10-4 to 10-11

Preparation of Silver Iodobromide Tabular Grain Emulsion Samples Doped with Compound C-2, C-4, C-6, C-15, C-18, C-21, C-25 or C-28 (Samples of the Invention)

Emulsions 10-4 to 10-11 were prepared in the same manner as in the preparation of emulsion 10-1 except that to the area corresponding to 80 to 100% in grain volume was added each in an amount of $5\times10^{-5}$ mol of Compound C-2, C-4, C-6, C-15, C-18, C-21, C-25 or C-28, each per mol of the silver of the entire grain.

To each of the above-obtained emulsions 10-1 to 10-11 were added sodium thiosulfate in an amount of $8.0\times10^{-6}$ mol, chloroauric acid in an amount of $3\times10^{-6}$ mol, and potassium thiocyanate in an amount of $1.2\times10^{-5}$ mol, each per mol of the silver, and each emulsion was optimally chemically sensitized at 60° C. Each emulsion was coated on a support in the same manner as in Example 1. Each of these samples was subjected to sensitometric exposure ($10^{-2}$ sec.) through an optical wedge, development processing in the same manner as in Example 1, and then stopping, fixing, washing and drying by ordinary methods. Optical density of each sample was measured. The relative sensitivity obtained when each of coated samples 10-1 to 10-11 (samples to which the spectral sensitizing dye was not added) was exposed with the intrinsic absorption wavelength of the silver halide is shown in Table 7. Dmax of each sample after development processing was measured using red light (R light).

TABLE 7

| Sample No. | Emulsion No. | Dopant | Addition Amount (mol/mol Ag) | Relative*1 Sensitivity ($10^{-1}$ sec. exposure) | Dmax |
|---|---|---|---|---|---|
| 10-1 (Comparison) | 10-1 | None | | 100 | 1.72 |
| 10-2 (Comparison) | 10-2 | $[Fe(CN_6)]^{4-}$ | $1\times10^{-4}$ | 110 | 1.80 |
| 10-3 (Comparison) | 10-3 | $[Ru(CN_6)]^{4-}$ | $1\times10^{-4}$ | 105 | 1.81 |
| 10-4 (Invention) | 10-4 | Compound C-2 of the Present Invention | $5\times10^{-5}$ | 126 | 1.87 |
| 10-5 (Invention) | 10-5 | Compound C-4 of the Present Invention | $5\times10^{-5}$ | 123 | 1.85 |
| 10-6 (Invention) | 10-6 | Compound C-6 of the Present Invention | $5\times10^{-5}$ | 120 | 1.84 |
| 10-7 (Invention) | 10-7 | Compound C-15 of the Present Invention | $5\times10^{-5}$ | 116 | 1.83 |
| 10-8 (Invention) | 10-8 | Compound C-18 of the Present Invention | $5\times10^{-5}$ | 111 | 1.81 |
| 10-9 (Invention) | 10-9 | Compound C-21 of the Present Invention | $5\times10^{-5}$ | 115 | 1.82 |
| 10-10 (Invention) | 10-10 | Compound C-25 of the Present Invention | $5\times10^{-5}$ | 121 | 1.85 |
| 10-11 (Invention) | 10-11 | Compound C-28 of the Present Invention | $5\times10^{-5}$ | 137 | 1.84 |

*1The sensitivity of each sample was shown as a relative sensitivity with the sensitivity of sample 10-1 as 100.

Compounds C-2, C-4, C-6, C-15, C-18, C-21, C-25 and C-28, which showed high effect of increasing sensitivity in silver bromide octahedral grain emulsions, were used as dopants. It was found that the emulsions doped with any of these dopants could exhibit higher effect of increasing sensitivity with a less addition amount than the emulsion doped with the dopant so far been used for increasing sensitivity, e.g., $[Fe(CN)_6]^{4-}$ or $[Ru(CN)_6]^{4-}$.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon at least a silver halide emulsion layer containing silver halide grains, wherein said silver halide grains are doped with at least one metal complex containing in any of groups A, B and C:

group A: an optically active metal complex;

group B: a metal complex comprising a metal ion selected from the group consisting of transition metallic elements belonging to period 4 to 6 and group III to XI of the Periodic Table, and typical metallic elements belonging to period 4 to 6 and group XII to XIV of the Periodic Table, and at least one ligand represented by the following formula (I):

(I)

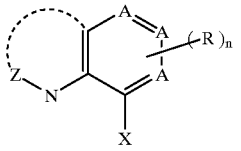

wherein Z represents an atomic group to form a 5- or 6-membered ring; A represents a carbon atom or a nitrogen atom; X represents O–, S–, $NR_1R_2$ or COO—; $R_1$ and $R_2$ each represents a hydrogen atom or an alkyl group; R represents a substituent; and n represents an integer of from 0 to 6;

group C: a metal complex selected from the group consisting of a porphyrin complex, a porphycene complex, a phthalocyanine complex, a chlorin complex, and a bacteriochlorin complex.

2. The silver halide photographic material as claimed in claim 1, wherein the metal complex of group A is an optically active metal complex having as a central metal a metal ion selected from the group consisting of transition metallic elements belonging to period 4 to 6 and group III to XI of the Periodic Table, and typical metallic elements belonging to period 4 to 6 and group XII to XIV of the Periodic Table.

3. The silver halide photographic material as claimed in claim 2, wherein the optically active metal complex of group A is a Δ body or Λ body.

4. The silver halide photographic material as claimed in claim 2, wherein the optically active metal complex of group A is a complex having at least one diketone compound as a ligand.

5. The silver halide photographic material as claimed in claim 1, wherein the metal complex of group B is a metal complex exclusive of complexes in which half or more conformations of all the ligands of the metal ions are occupied with monovalent anionic ligands.

6. The silver halide photographic material as claimed in claim 1, wherein the metal complex of group C is a metal complex selected from the group consisting of a porphyrin complex having a hydrophilic group, a porphycene complex having a hydrophilic group, a phthalocyanine complex having a hydrophilic group, and a bacteriochlorin complex having a hydrophilic group, and each of which contains a metal ion selected from the group consisting of transition metallic elements belonging to period 4 to 6 and group III to XI of the Periodic Table, and typical metallic elements belonging to period 4 to 6 and group XII to XIV of the Periodic Table.

7. The silver halide photographic material as claimed in claim 6, wherein the metal ion contained in the metal complex is a transition metallic element belonging to period 4 to 6 and group III to XI of the Periodic Table.

8. The silver halide photographic material as claimed in claim 6, wherein the hydrophilic group contained in the metal complex is a carboxyl group, a sulfo group, a hydroxyl group, or a quaternary salt.

9. The silver halide photographic material as claimed in claim 8, wherein the solubility of the complex in water is 1 mM or more.

10. The silver halide photographic material as claimed in claim 1, wherein the material contains silver halide grains into which dislocation lines are introduced.

11. The silver halide photographic material as claimed in claim 10, wherein the dislocation lines are screw dislocations.

12. The silver halide photographic material as claimed in any of claims 1 to 11, wherein the material contains at least one silver halide emulsion in which tabular silver halide grains having an aspect ratio of 8 or more account for 60% or more of the entire projected area.

13. The silver halide photographic material as claimed in claim 1 which comprises a support having provided thereon at least one blue-sensitive emulsion layer, a green-sensitive emulsion layer, a red-sensitive emulsion layer and a hydrophilic protective colloid layer.

14. A silver halide photographic material comprising a support having provided thereon at least a silver halide emulsion layer, wherein the material contains at least one metal complex containing in any of groups A, B and C:

group A: an optically active metal complex;

group B: a metal complex comprising a metal ion selected from the group consisting of transition metallic elements belonging to period 4 to 6 and group III to XI of the Periodic Table, and typical metallic elements belonging to period 4 to 6 and group XII to XIV of the Periodic Table, and at least one ligand represented by the following formula (I):

(I)

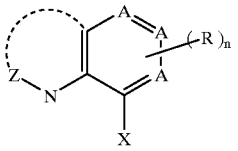

wherein Z represents an atomic group to form a 5- or 6-membered ring; A represents a carbon atom or a nitrogen atom; X represents O–, S–, $NR_1R_2$ or COO–; $R_1$ and $R_2$ each represents a hydrogen atom or an alkyl group; R represents a substituent; and n represents an integer of from 0 to 6;

group C: a metal complex selected from the group consisting of a porphyrin complex, a porphycene complex, a chlorin complex, and a bacteriochlorin complex.

15. The silver halide photographic material as claimed in claim 14, wherein the metal complex of group C is a metal complex selected from the group consisting of a porphyrin complex having a hydrophilic group, a porphycene complex having a hydrophilic group, and a bacteriochlorin complex having a hydrophilic group, and each of which contains a metal ion selected from the group consisting of transition metallic elements belonging to period 4 to 6 and group III to XI of the Periodic Table and typical metallic elements belonging to period 4 to 6 and group XII to XIV of the Periodic Table.

16. The silver halide photographic material as claimed in claim 14, wherein the material contains at least one silver halide emulsion in which tabular silver halide grains having an aspect ratio of 8 or more account for 60% or more of projected area.

17. The silver halide photographic material as claimed in claim 14, which comprises a support having provided thereon at least one blue-sensitive emulsion layer, a green-sensitive emulsion layer, a red-sensitive emulsion layer and a hydrophilic protective colloid layer.

* * * * *